US010583573B2

(12) United States Patent
Erndt et al.

(10) Patent No.: US 10,583,573 B2
(45) Date of Patent: Mar. 10, 2020

(54) ELECTRIC SHAVER

(71) Applicant: Braun GmbH, Kronberg (DE)

(72) Inventors: Andreas Erndt, Kelkheim (DE); Philipp Berger, Bad Vilbel (DE); Cirilo Javier Perez Lopez, Frankfurt am Main (DE); Diana Kappes, Boston, MA (US)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 15/711,488

(22) Filed: Sep. 21, 2017

(65) Prior Publication Data

US 2018/0085934 A1 Mar. 29, 2018

(30) Foreign Application Priority Data

Sep. 28, 2016 (EP) ..... 16191097

(51) Int. Cl.

| | |
|---|---|
| ***B26B 19/04*** | (2006.01) |
| ***B26B 19/40*** | (2006.01) |
| ***B26B 19/38*** | (2006.01) |
| ***B26B 19/48*** | (2006.01) |

(52) U.S. Cl.

CPC ..... *B26B 19/046* (2013.01); *B26B 19/048* (2013.01); *B26B 19/382* (2013.01); *B26B 19/3813* (2013.01); *B26B 19/3853* (2013.01); *B26B 19/40* (2013.01); *B26B 19/48* (2013.01)

(58) Field of Classification Search

CPC ... B26B 19/046; B26B 19/3813; B26B 19/48; B26B 19/048; B26B 19/40; B26B 19/382; B26B 19/3853

See application file for complete search history.

(56) References Cited

U.S. PATENT DOCUMENTS

| | | | | |
|---|---|---|---|---|
| 4,114,264 A * | 9/1978 | Buchholz | B26B 19/107 30/34.1 |
| 4,930,217 A * | 6/1990 | Wolf | B26B 19/048 30/34.1 |
| 5,233,746 A * | 8/1993 | Heintke | B26B 19/048 30/34.05 |
| 5,257,456 A | 11/1993 | Franke et al. | |
| 5,410,811 A * | 5/1995 | Wolf | B26B 19/048 30/43.9 |

(Continued)

FOREIGN PATENT DOCUMENTS

| | | |
|---|---|---|
| EP | 1403011 | 3/2004 |

OTHER PUBLICATIONS

European search report dated May 17, 2017.

*Primary Examiner* — Jonathan G Riley
(74) *Attorney, Agent, or Firm* — Kevin C. Johnson

(57) ABSTRACT

The present invention relates to an electric shaver comprising a shaver housing, a shaver head including at least one cutter element drivable by a drive unit in an oscillating manner along a cutter oscillation axis and a non-cutting auxiliary function element for applying an auxiliary skin treatment other than hair cutting to a skin portion to be shaved, said auxiliary function element having an applicator head positioned aside the cutter element. The shaver head and/or the at least one cutter element is supported pivotably relative to the auxiliary function element at least about a pivot axis parallel to the cutter oscillation axis.

8 Claims, 14 Drawing Sheets

(56) References Cited

U.S. PATENT DOCUMENTS

| | | | | |
|---|---|---|---|---|
| 5,542,179 | A * | 8/1996 | Beutel | B26B 19/048 30/43 |
| 5,611,145 | A * | 3/1997 | Wetzel | B26B 19/044 30/43.92 |
| 5,704,126 | A | 1/1998 | Franke et al. | |
| 6,226,871 | B1 * | 5/2001 | Eichhorn | B26B 19/048 30/346.51 |
| 6,381,849 | B2 * | 5/2002 | Eichhorn | B26B 19/02 30/346.51 |
| 7,162,801 | B2 * | 1/2007 | Royle | B26B 19/048 30/43.92 |
| 8,555,510 | B2 | 10/2013 | Fuerst et al. | |
| 9,457,485 | B2 * | 10/2016 | Pohl | B26B 19/38 |
| 2002/0157257 | A1 * | 10/2002 | Oswald | B26B 19/048 30/43.92 |
| 2006/0085984 | A1 * | 4/2006 | Oh | B26B 19/048 30/43.92 |
| 2006/0143924 | A1 | 7/2006 | Mercurio | |
| 2007/0062042 | A1 * | 3/2007 | Kleemann | B26B 19/40 30/45 |
| 2008/0134515 | A1 * | 6/2008 | Sato | B26B 19/046 30/43.91 |
| 2011/0099814 | A1 * | 5/2011 | Fuerst | A45D 27/46 30/34.05 |
| 2014/0290452 | A1 * | 10/2014 | Burghardt | B26B 19/388 83/15 |
| 2016/0325444 | A1 * | 11/2016 | Langsdorf | B26B 19/382 |
| 2016/0327314 | A1 * | 11/2016 | Langsdorf | B26B 19/382 |

* cited by examiner (D-D)

(C-C)

ELECTRIC SHAVER

FIELD OF THE INVENTION

The present invention relates to electric shavers providing for non-cutting auxiliary functions such as for example combing, cooling, heating or lubricating the skin to be shaved. More particularly, the present invention relates to an electric shaver comprising a shaver housing, a shaver head including at least one cutter element drivable by a drive unit in an oscillating manner along a cutter oscillation axis and a non-cutting auxiliary function element for applying an auxiliary skin treatment other than hair cutting to a skin portion to be shaved, said auxiliary function element having an applicator head positioned aside the cutter element. The present invention further relates to an electric shaver, comprising a shaver handle housing, a shaver head including at least one cutter element drivable by a drive unit in an oscillating manner along a cutter oscillation axis wherein said drive unit includes at least one elongated drive transmitter extending from said shaver housing into said shaver head and coupled to said at least one cutter element, said elongated drive transmitter is coupled to said cutter element by means of a pivot joint. The present invention also relates to a shaver head for such an electric shaver.

BACKGROUND OF THE INVENTION

Electric shavers may have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner. The said electric drive may include an electric motor or a magnetic type linear motor, wherein the drive unit may include an elongated drive transmitter for transmitting the driving motion of the motor to the cutter element.

Such drive systems are sometimes quite complex in structure due to the fact that, in addition to the aforementioned cutting motion, the cutter elements may be movable in other directions so as to adapt to the contour of the skin to be shaved. For example, the cutter elements may be part of a shaver head that is pivotably supported relative to the shaver housing, wherein the pivot axis of such shaver head may extend transverse to the longitudinal direction of the shaver housing. In addition or in the alternative to such shaver head movements, the cutter elements may be movably supported relative to the shaver head so as to adjust their position relative to the skin.

For example, US 2009/0025229 A1 discloses an electric shaver having a shaver head pivotably supported relative to the shaver housing about a shaver head pivot axis extending transverse to the longitudinal axis of the shaver housing. A pair of cutter elements provided under a shear foil can be driven in an oscillating manner along a cutter oscillation axis substantially parallel to said shaver head pivot axis. To transmit the driving action of an electric motor accommodated in the shaver housing to the cutter elements, the drive unit includes transmitter pins extending from the shaver housing towards the shaver head, wherein the oscillating driving movements of said transmitter pins are applied onto the cutter elements via an oscillatory bridge supported for oscillatory reciprocation in said shaver head, wherein said oscillatory bridge includes yielding coupling arms so as to compensate for the adjusting movements of the cutter elements. Due to the rather complex shape of the oscillatory bridge, however, the transmission architecture is rather complicated. Moreover, the yielding structure of the oscillatory bridge is power-consuming and detrimental to achieving high frequencies of oscillation of the cutter elements.

A similar transmission architecture including an oscillation bridge of a pivoting type is known from U.S. Pat. No. 7,841,090 B2.

Self-adjusting movements of the cutter elements to adapt to the skin contour becomes more difficult when the shaver head includes auxiliary function elements such as a cooling element for cooling the skin to be shaved or lubricating elements for lubricating the skin to be shaved. Such non-cutting auxiliary function elements do not only require additional space in the shaver head, but sometimes interfere with the desired movability of the cutter elements. The auxiliary function elements have sometimes application heads positioned close to or adjacent to the cutter elements so as to contact the skin portion to be shaved or apply the auxiliary function thereto, wherein it is sometimes desirable that the auxiliary function element does not participate in the self-adjusting movements of the cutter elements. For example, it is sometimes desirable to have a rigidly supported auxiliary function element that can be pressed against the skin with a higher pressure than the cutter elements. Furthermore, movably supporting the auxiliary function elements to allow self-adjustment in a way similar to the cutter elements renders the shaver head even more bulky and makes it difficult to connect the auxiliary function elements to supportive components such as thermal elements like Pelletier elements or storage elements like lubricant tanks.

WO 2010/003603 A1 describes an electric shaver having a cooling element as an auxiliary function element, wherein said cooling element includes rib-shaped contact portions extending along the cutter elements on an outer side of the shaver head and between said cutter elements. The cutter elements are supported against said cooling element by means of springs so that the cutter elements may dive in a direction substantially parallel to the longitudinal axis of the shaver housing, i.e. the cutter elements may dive into the shaver head due to skin contact pressure. Aside from such diving movements, however, the cutter elements may not execute any other self-adjusting movements and the entire shaver head is rigidly held in position due to the fixedly positioned cooling elements.

SUMMARY OF THE INVENTION

It is an objective underlying the present invention to provide for an improved electric shaver avoiding at least one of the disadvantages of the prior art and/or further developing the existing solutions. A more particular objective underlying the invention is to provide for an improved shaver head structure with improved co-existence of cutter elements and non-cutting auxiliary function elements with less interference of the auxiliary function elements with the kinematics of the cutter elements. Another objective underlying the present invention is to allow for further self-adaption of the cutter elements to the skin contour, in particular to allow for multi-axial pivoting adjustments of the cutter elements without sacrificing an easy structure and support of the auxiliary function elements and to allow for a position of such auxiliary function elements close to the cutter elements.

To achieve at least one of the aforementioned objectives, the electric shaver has an improved shaver head structure allowing for pivoting movements of the cutter element relative to the auxiliary function element. More particularly, the shaver head and/or the at least one cutter element is supported pivotably relative to the auxiliary function element at least about a pivot axis parallel to the cutter oscillation axis. When moving the electric shaver with its shaver head across the skin, the cutter element may self-adjust its angular orientation to perpendicularly contact the skin by means of pivoting about said pivot axis parallel to the cutter oscillation axis, wherein the auxiliary function element does not need to participate in such pivoting adjustment.

Pivotably supporting the entire shaver head and/or the at least one cutter element relative to the auxiliary function element about said pivot axis parallel to the cutter oscillation axis or about further pivot axes having other orientations, allows for a simple structure and simple support of the auxiliary function element, thus saving space in the shaver head, but nevertheless allows for adjustment movements of the cutter element to adapt the angular position of the cutter element to the skin contour and to compensate misalignment of the shaver housing to the skin contour.

At least one of the aforementioned objective is further achieved by an electric shaver, comprising a shaver handle housing, a shaver head including at least one cutter element (drivable by a drive unit in an oscillating manner along a cutter oscillation axis wherein said drive unit includes at least one elongated drive transmitter extending from said shaver housing into said shaver head and coupled to said at least one cutter element, said elongated drive transmitter is coupled to said cutter element by means of a pivot joint wherein said shaver head and/or said at least one cutter element is supported pivotably relative to said pivot joint and/or relative to said drive transmitter at least about a pivot axis parallel to said cutter oscillation axis. The at least one cutter element may pivot around the pivot joint of said drive transmitter relative to said shaver handle housing about a shaver head pivot axis. The drive unit including the transmitter is stationary (disregarding or except for the motor drive movement) connected with the shaver handle housing relative to any cutter unit skin contour adaption movements.

These and other advantages become more apparent from the following description giving reference to the drawings and possible examples.

DETAILED DESCRIPTION OF THE INVENTION

Figure 1:
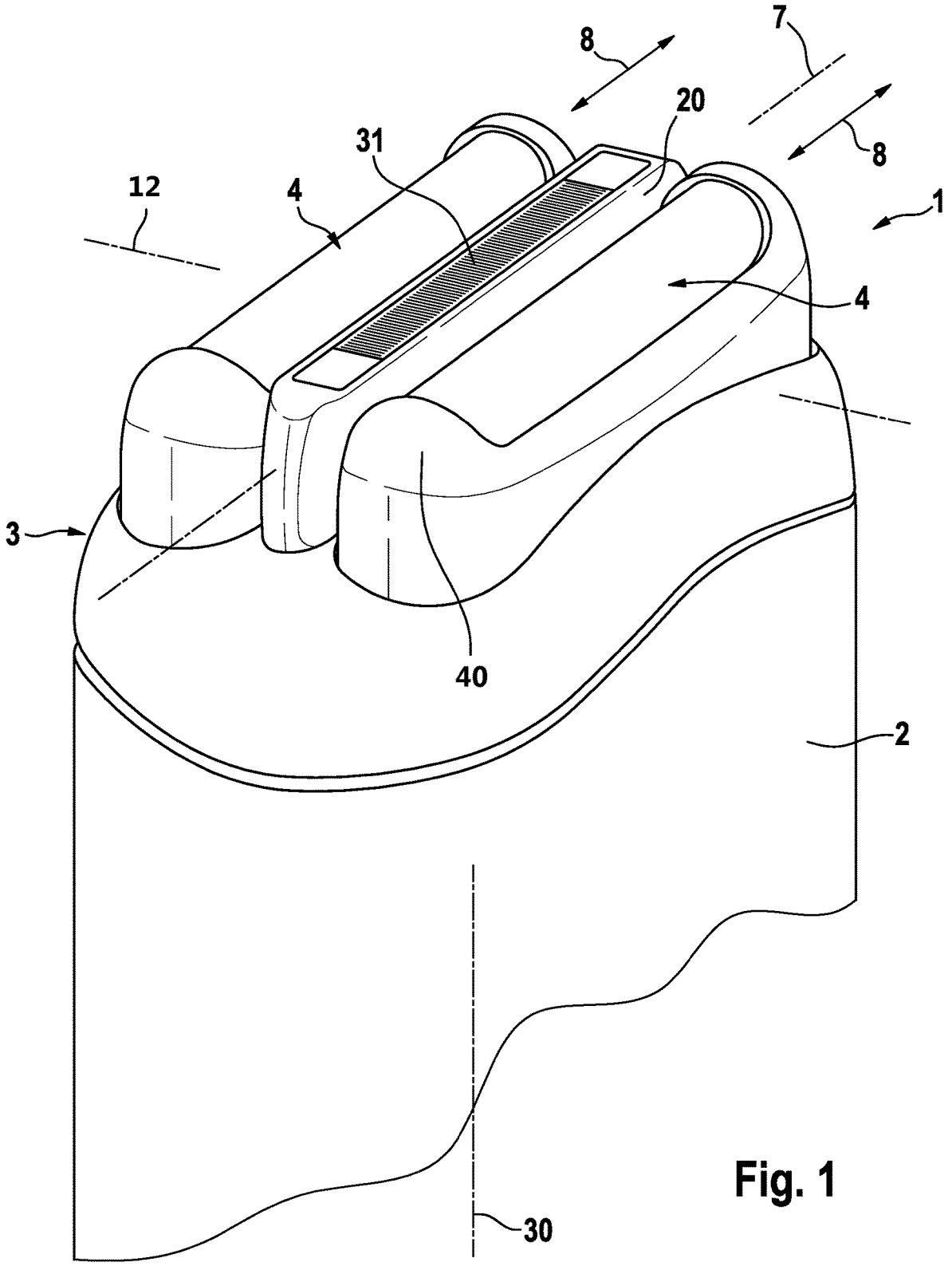
FIG. 1: is a perspective partial view of an electric shaver having a shaver head pivotably supported relative to a shaver housing, said shaver head including two cutter elements drivable in an oscillating manner and each pivotably supported relative to a shaver head frame, wherein a non-cutting, auxiliary function element is positioned between said two cutter elements.

In order to allow flexible, yielding self-adjusting movements of the cutter element to achieve self-adaption to the skin contour and compensation of misalignment of the handpiece relative to the skin contour, but still providing for a simple structure and simple support of the non-cutting auxiliary function element, the shaver head and/or the at least one cutter element is supported pivotably relative to the auxiliary function element at least about a pivot axis parallel to said cutter oscillation axis. Such pivot axis extending substantially parallel to the cutter oscillation axis allows for self-adjustment of the angular orientation of the cutter element and thus adapting to the skin contour better than just diving movements which diving movements nevertheless are possible.

Such pivoting relative to the auxiliary function element may be carried out by the shaver head including the cutter element, more particularly a shaver head support structure together with the cutter element supported thereon so that the shaver head frame together with the at least one cutter element may pivot together relative to the auxiliary function element. More particularly, almost the entire shaver head structure exclusive the auxiliary function element, but inclusive the oscillating cutter element may together pivot about the aforementioned pivot axis.

In addition or in the alternative to such comprehensive pivoting of the shaver head, the oscillating cutter element may pivot relative to the shaver head, more particularly relative to the shaver head base structure or shaver head frame so that the cutter element independently from the shaver head base structure may pivot relative to the auxiliary function element.

Said auxiliary function element may be rigidly supported to extend in a fixed orientation and/or in a fixed position relative to the shaver housing and/or relative to the shaver head frame or shaver head housing. Thus, the auxiliary function element does not need to participate in the pivoting adjustment of the auxiliary function element, but may maintain its given position and/or fixed orientation irrespective of pivoting adjustments of the cutter element.

The auxiliary function element may be adapted to apply varying non-cutting auxiliary functions to the skin that is shaved by the cutter element. More particularly, the auxiliary function element may include a skin cooler or a skin heater for cooling and/or heating the skin to be shaved. Such skin cooler and/or skin heater may include a skin contact portion cooperating with a thermal element such as a Peltier element. In addition or in the alternative to such skin cooling and/or heating, the auxiliary function element may include a liquid applicator for applying a liquid to the skin portion to be shaved or having been shaved, wherein such liquid may include odor or fragrance agents, skin calming agents, disinfecting agents and/or other skin treatment agents. Furthermore, the auxiliary function element may include a lubricator for applying lubricant to the skin portion. Other media to be applicable to the skin may include or consist of gas, powder, foam or gel so the auxiliary function element may include a gas applicator, a powder applicator, a foam applicator and/or a gel applicator. For example, a gas applicator may include a fan blowing air onto the skin, wherein the air flow may include powders such as skin smoothening and/or coloring particles. Furthermore, foams such as lubricating or shaving foams or gels such as skin calming gels may be applied onto the skin wherein the applicator head may include a delivering pad or ball like a deodorant stick.

According to a further aspect, the applicator head of the auxiliary function element may include an uncovered contact surface for contacting the skin portion or at least facing the skin portion with only a small gap being between the applicator head's contact surface and the skin portion.

The applicator head of the auxiliary function element and/or the aforementioned contact surface may form a portion of the outer contour of the shaver head to allow for influence onto the skin and to apply the auxiliary function to the skin.

Basically, the applicator head of the auxiliary function element may be positioned at different portions of the shaver head. For example, the auxiliary function element may have an elongated applicator head extending along a side of the cutter element, for example along a principal side of the cutter element extending substantially parallel to the cutter oscillation axis. Taking into account a main handling direction of the shaver along which the shaver head is moved across the skin, the auxiliary function element may extend in front of and/or at the rear side of the cutter element. The aforementioned main handling direction may extend substantially perpendicular to the cutter oscillation axis and/or substantially perpendicular to the shaver housing's longitudinal axis and/or substantially perpendicular to the longitudinal axis of the cutter element having an elongated shape. The auxiliary function element may be positioned such that it runs within the track laid by at least one cutter element and/or at least one cutter element runs within the track laid by the auxiliary function element when the shaver head is moved across the skin along the said main handling direction of the shaver.

More particularly, the auxiliary function element may extend from the shaver housing through the internal structure of the shaver head and/or inside a shaver head housing with the applicator head of the auxiliary function element forming a part of a skin contact side of the shaver head and/or a top side of the shaver head turned away from the shaver housing. The function element may extend through an interior of the shaver head and/or through the interior structure of the shaver head so that structural elements and/or structural portions of the shaver head may be positioned on opposite sides of the auxiliary function element or may surround the auxiliary function element.

For example, the auxiliary function element may be rigidly connected to a shaver housing and project from said shaver housing into the shaver head through which it extends to the shaver head's skin contact side. When the auxiliary function element is mounted to the shaver housing, the shaver head including a shaver head frame supporting the cutter element may be pivotably supported and may be allowed to pivot relative to the auxiliary function element by means of an easy, simple support structure. In the alternative, the auxiliary function element may be mounted to the shaver head, more particularly to a shaver head support structure onto which the cutter element is pivotably supported or onto a shaver head housing.

The shaver head may include only one cutter element, but the shaver head also may include two, three or more cutter elements. When the shaver head includes a plurality of cutter elements, the applicator head of the auxiliary function element may be positioned between a pair of said plurality of cutter elements. For example, the auxiliary function element may be positioned such that it follows at least one cutter element and moves in advance of at least another cutter element when considering movement of the shaver head across the skin to be shaved. In other words, the auxiliary function element may be positioned such that it runs within the track laid by at least one cutter element, wherein at least another cutter element runs within the track laid by the auxiliary function element.

When there are a plurality of cutter elements, each of said plurality of cutter elements may be pivotably supported about at least said pivot axis parallel to the cutter oscillation axis, wherein each of the cutter elements may have its own pivot axis or, in the alternative, at least two of the plurality of cutter elements may share a common pivot axis parallel to the cutter oscillation axis. When there are cutter elements having their own pivot axis, such separate pivot axis may extend substantially parallel to each other, but spaced apart from each other.

Pivoting of the plurality of cutter elements may be controlled in different ways. For example, the cutter elements and/or their support structures may be linked to each other such that they pivot together about said pivot axis. For example, the cutter elements may be supported on a common pivot frame which may execute the aforementioned pivoting about a pivot axis parallel to the oscillation axis, thus effecting a joint pivoting of the cutter elements in the same angular direction. In the alternative, the cutter elements may be supported on separate pivot frames wherein such separate pivot frames may be linked to each other, for example by means of a toothing or a toothed transmission, and/or by means of a control arm arrangement so that the pivotably supported cutter elements are caused to pivot in directions contrary to each other.

In the alternative to such controlled pivoting where one cutter element pivots in response to pivoting of another cutter element, the cutter elements may, according to a further aspect, pivot independently from each other about a pivot axis parallel to the cutter oscillation axis. Due to such independent pivotable support of the cutter elements, each cutter element may adapt its position and/or angular orientation to the skin contour without being affected by pivoting of the other cutter element. Thus, each cutter element may individually find its position to the skin contour. For example, the cutter element may be supported on separate support frames allowed to pivot independently from each other.

The aforementioned pivoting about a pivot axis parallel to the cutter oscillation axis does not need to be the only degree of freedom of the at least one cutter element relative to the non-cutting auxiliary function element. According to a further aspect, the at least one cutter element may be multi-axially pivotably supported relative to said auxiliary function element and/or relative to a shaver head frame of the shaver head about a pair of pivot axes extending perpendicular to each other and substantially transverse to a longitudinal axis of the shaver housing. Such multi-axial pivoting movement of the cutter element allows for self-adjustment of the cutter element in various ways and thus adaption to various skin contours and various misalignments of the shaver housing to the skin to be shaved.

In addition or in the alternative to such multi-axially pivotable support, the at least one cutter element also may be movably supported for linear displacement, e.g. to allow diving of the cutter element along a displacement axis substantially parallel to the shaver housing's longitudinal axis. In addition or in the alternative to such diving, the cutter element also may be allowed to linearly displace in a direction substantially perpendicular to the oscillation axis and transverse to the shaver housing's longitudinal axis, e.g.

so as to allow for yielding of the cutter element when being pressed onto the skin in a rather inclined way.

The aforementioned multi-axial pivoting and/or the additional linear displacement may be controlled as described before. For example, multi-axial pivoting of one cutter element may be controlled in response to multi-axial pivoting of another cutter element and vice versa, for example, by means of control links between the cutter elements. In the alternative, the cutter elements may execute multi-axial pivoting independently from each other. With regard to linear displacement, it is also possible to control linear displacement of one cutter element in response to linear displacement of another cutter element, e.g. such that a pair of cutter element dives together into the shaver head. In the alternative, the cutter elements may be supported separately to allow for linear displacements of the cutter elements independently from each other.

The transmission train for transmitting the drive power and movements of the electric motor to the at least one cutter element may have varying architectures and structures depending on the type of motor and the arrangement thereof. For example, the drive unit may include a rotatory electric motor or a magnetic-type linear motor, wherein irrespective of its type the motor may be arranged in the shaver housing or in the shaver head. In order to allow for the aforementioned self-adjustment of the cutter element, the transmission train includes corresponding degrees of freedom which may be realized in terms of pivotable joints and/or linearly displaceable connections.

To avoid collisions between the transmission train and the non-cutting auxiliary function element, the transmission train may be adapted to allow for pivoting and/or linearly displacing movements of the cutter elements in a region close to said cutter element so that other parts of the transmission train may avoid any movements in a direction transverse to the cutter oscillation axis and transverse to the longitudinal axis of the shaver housing. In particular, the transmission train may be adapted to lack any oscillation bridge within the shaver head which oscillation bridges often include a bridge supported by yielding or flexible support arms, thereby rendering the bridge structure rather bulky and space-consuming.

The electric shaver may provide for a direct coupling of an elongated drive transmitter to the cutter element avoiding any oscillatory yielding bridge structure between the elongated drive transmitter and the cutter element. More particularly, the elongated drive transmitter may be coupled to the cutter element by means of a pivot joint providing for a pair of pivot axes extending perpendicular to each other and transverse to a longitudinal axis of said elongated drive transmitter. In order to allow for adjusting movement of the cutter element transverse to the cutting oscillation, the pivot joint may be displaceably mounted to the elongated drive transmitter and/or to the cutter element to allow for displacement of the pivot joint relative to the elongated drive transmitter and/or to the cutter element in a direction transverse to the cutter oscillation axis and transverse to the longitudinal axis of the elongated drive transmitter.

A direct, pivotable connection of the elongated drive transmitter to the cutter element may help in achieving low power dissipation of the transmission train and a direct response of the cutter element to the driving movements of the elongated drive transmitter, thus allowing for high oscillation frequencies. The elongated drive transmitter may extend to or into the cutter element and directly push and/or pull the cutter element to effect the cutting movement. The pivot joint coupling the elongated drive transmitter to the cutter element helps in allowing for adjustment movements of the cutter element transverse to the longitudinal axis of the elongated drive member and/or transverse to the cutting oscillation despite a possible direct transmission of driving action along the axis of oscillation without play between the elongated drive transmitter and the cutter element.

In order to achieve instantaneous play-free driving of the at least one cutter element along the cutter oscillation axis as well as allowing yielding self-adjusting movements of the cutter element along and/or about further axes other than said oscillation axis to achieve self-adaption of the cutter element to the skin contour and compensation of misalignment of the handpiece relative to the skin contour, the drive train may dispense with any yielding oscillation bridge between the elongated drive transmitter and the cutter element, but the elongated drive transmitter may extend to the cutter element and may be directly connected to the cutter element by means of a pivot joint, wherein said pivot joint may form the only axes of freedom and/or axes of movability of the cutter element relative to the elongated drive transmitter.

The pivot joint may be the only structural element or spot of the transmission train where the cutter element may move relative to the elongated drive transmitter.

To achieve a stiff transmission characteristic with low losses for the cutting movement along the cutter oscillation axis on the one hand and allow for self-adaption of the cutter element along and/or about other axes, the said pivot joint may be adapted to be free of any play relative to the said cutter oscillation axis, wherein in particular the engagement of the pivot joint with the elongated drive transmitter and the cutter element may be adapted to be free of play relative to said cutter oscillation axis. On the other hand, the said pivot joint may be adapted to provide for play along displacement axes other than said oscillation axis and/or provide for freedom to pivot about one or more pivot axes.

Depending on the type of electric shaver, the drive unit which may include a rotatory electric motor or a magnetic-type linear motor, may be accommodated within the shaver housing. In the alternative, the rotatory or linear motor may be accommodated within the shaver head.

The aforementioned elongated drive transmitter for transmitting torque, force, power and/or movements from the motor to the cutter element, may extend from the shaver housing into the shaver head, wherein the elongated drive transmitter may have a longitudinal axis substantially in parallel with the longitudinal axis of the handpiece. When the drive unit has a motor accommodated in the shaver head, the elongated drive transmitter may extend from an interior of the shaver housing to the exterior of the shaver housing, in particular within a region facing the shaver head. When the motor is accommodated within the shaver head, the elongated drive transmitter may extend, with its longitudinal axis, substantially in parallel with a main axis of the shaver head.

To achieve a stiff transmission characteristic and avoid transmission losses, the said elongated drive transmitter may form a rigid drive pin which has a sufficient stiffness and strength, and is adapted to not bend or deform under operative loads. For example, it may be a metal pin.

According to another aspect, said elongated drive transmitter may be supported to extend in a fixed angular orientation and to oscillate uniaxially relative to said shaver housing along an axis perpendicular to the longitudinal axis of said elongated drive transmitter. The elongated drive transmitter may execute a purely linear displacement without pivoting about any axis, wherein the elongated drive transmitter may be held with its longitudinal axis substantially parallel to the longitudinal axis of the shaver housing. Basically, the said linear displacement of the elongated drive transmitter may follow a curved path such as an oval path or an s-shaped path of oscillation. According to another aspect, said linear displacement may follow a straight path in terms of a reciprocation or oscillation along an axis which may extend substantially parallel to the pivot axis of the shaver head and/or parallel to the longitudinal extension of the cutter element.

Depending on the configuration of the cutter element and its mounting or support structure, the elongated drive transmitter may have a length to end before or at the cutter element or to extend into an interior transmitter recess formed in said cutter element in which an end portion of said elongated drive transmitter is received pivotably about said pair of pivot axes transverse to the drive transmitter's longitudinal axis and displaceable in said direction transverse to said cutter oscillation axis and transverse to said longitudinal axis of the elongated drive transmitter. An extension of the elongated drive transmitter into an interior transmitter recess may bring the position of the pivot axis close to the cutting and/or shearing surfaces of the cutter element and therefore, may reduce the length of a lever arm going from the point where forces are transmitted by the pivot joint onto the cutter element to the point where resistive forces due to cutting or shearing are applied to the cutter element. Thus, a tendency of pivoting of the cutter element due to driving forces and the lever arm thereof may be reduced.

The pivot joint between the elongated drive transmitter and the cutter element may be realized in different ways. For example, the elongated drive transmitter may be in direct engagement and/or in direct contact with body walls of the cutter element defining the aforementioned interior transmitter recess forming the pivot joint. When the elongated drive transmitter is formed by a rigid drive pin, the said drive pin may be in direct engagement with the walls defining said interior transmitter recess in the cutter element. Optionally, the drive pin may be provided with an engagement sleeve rigidly connected to the drive pin body and engaging with said transmitter recess. Such sleeve may have a cylindrical shape seated on the drive pin and form a replacement sleeve which may be replaced due to wear and tear or may form a sliding sleeve made of an appropriate material providing for smoothly sliding engagement with the cutter element.

The said interior transmitter recess of the cutter element may form an elongated, slot-like hole having convex sidewalls defining a gap the width of which substantially corresponds to a thickness or diameter of said elongated drive transmitter and the length of which is substantially larger than said thickness or diameter of the elongated drive transmitter, said width extending parallel to the cutter oscillation axis and said length extending transverse to the cutter oscillating axis and transverse to the longitudinal axis of the elongated drive transmitter. In particular, the elongated, slot-like hole may be adapted to receive the elongated drive transmitter substantially without play relative to the cutter oscillation axis and, on the other hand, to provide for play between the cutter element and the elongated drive transmitter relative to an axis transverse to the cutter oscillation axis and transverse to the longitudinal axis of the elongated drive transmitter. Thus, a stiff transmission characteristic relative to the cutter oscillation axis is achieved, whereas on the other hand self-adaption movements of the cutter element to the skin contour are possible and compensation of misalignment due to, for example, pivoting movement of the shaver head and/or adjusting movements of the cutter element relative to the shaver head can be achieved. The convex shape of the sidewalls defining the slot-like hole receiving the drive transmitter provides for a pivoting degree of freedom and allows for pivoting adjustment of the cutter element relative to the elongated drive transmitter about a pivot axis substantially transverse to the cutter oscillation axis and the longitudinal axis of the elongated drive transmitter.

According to another aspect, the pivot joint may include a block and/or sleeve-like connector connecting an end portion of said elongated drive transmitter to the cutter element, wherein said end portion of the elongated drive transmitter can be received in said connector piece mounted to the cutter element.

Said block-like connector may form a ball-joint piece having a substantially spherical support surface in pivotable engagement with a substantially spherical support surface of the cutter element and having a transmitter recess receiving the elongated drive transmitter. The said spherical support surfaces on the ball-joint piece and the cutter element do not need to define a complete sphere, but may define only a portion of such sphere, for example a spherical cap or a dome-shaped bearing surface. Nevertheless, it is possible that the spherical support surface of the ball-joint piece forms almost a complete sphere or a hemisphere or more than a hemisphere.

In particular, the said spherical support surfaces may be oriented and/or arranged so as to cover at least portions of the pivot joint containing and/or surrounding the cutter oscillation axis going through the pivot joint. In other words, the spherical support surfaces may be provided at least in regions of the pivot joint facing the reciprocation direction of the cutter element so as to transmit the driving forces in this direction. More particularly, the spherical support surfaces may be arranged such that the cutter oscillation axis goes perpendicularly through said spherical surfaces.

The elongated drive transmitter may be received in said ball-joint piece in different ways. According to an aspect, the transmitter recess of the connector may be adapted to prevent any movement of the block-like connector relative to the elongated transmitter piece in a direction parallel to the cutter oscillation axis and to allow for movement of the connector relative to the elongated drive transmitter along an axis transverse to the cutter oscillation axis and transverse to the elongated drive transmitter and/or pivoting movement about a pivot axis parallel to the cutter oscillation axis.

More particularly, the said transmitter recess of the connector may form an elongated, slot-like hole the width of which substantially corresponds to a thickness or a diameter of the elongated drive transmitter and a length of which is substantially larger than said thickness or diameter of the elongated drive transmitter to allow for displacement of the connector relative to the elongated drive transmitter in the direction transverse to said cutter oscillation axis and transverse to the longitudinal axis of the elongated drive transmitter. Such slot in the connector block allows for the aforementioned self-adjusting of the cutter element relative to the elongated drive transmitter along the displacement axis transverse to the cutter oscillation axis and transverse to the elongated drive transmitter and about a pivot axis parallel to the cutter oscillation axis. Further self-adjusting of the cutter element relative to the elongated drive transmitter in terms of a pivoting about a pivot axis transverse to the oscillation axis and transverse to the elongated drive transmitter can be effected by means of corresponding pivoting of the connector block relative to the cutter element.

In the alternative to the aforementioned slot-like transmitter recess of the connector allowing for displacement and/or pivoting of the connector block relative to the elongated drive transmitter, the said connector block also may be rigidly fixed to the elongated drive transmitter. To allow for adjusting movements of the cutter element relative to the elongated drive transmitter, the connector may have play relative to the support surface of the cutter element. More particularly, the aforementioned spherical support surface of the connector piece may be provided with flattening and/or bevelment portions providing for play of the connector relative to the cutter element and allowing for displacement of the cutter element relative to the elongated drive transmitter in the direction transverse to the cutter oscillation axis and transverse to the longitudinal axis of the elongated drive transmitter.

According to an aspect, such flattening and/or bevelment portions may extend on opposite sides of the ball-joint piece and/or be aligned substantially parallel to the cutter oscillation axis.

The block- and/or sleeve-like connector may be held in a substantially fixed rotatory orientation, in particular such that the longitudinal axis of the aforementioned slot-like hole and/or the aforementioned flattening or bevelment portion extend in their desired orientation. Rotation of the connector relative to the cutter element and/or relative to the elongated drive transmitter about an axis parallel to the longitudinal direction of the elongated drive transmitter may be prevented by means of a rotation preventer portion formed on said connector and engaging with a corresponding rotation preventer portion provided on the cutter element and/or on the elongated drive transmitter.

The aforementioned rotation preventer portion may form a projecting and/or recess engagement portion engaging with a recessed and/or projecting engagement portion of the cutter element. For example, such rotation preventer portion may include cylindrical or conical or dome-shaped axial stubs and corresponding stub-receiving recesses extending in a direction transverse to the cutter oscillation axis and transverse to the elongated drive transmitter.

The pivot joint support surfaces of the cutter element may be formed integrally or rigidly fixed to a cutter element body of the cutter element. Such pivot joint support surfaces may be formed directly by the material of the cutter element body. In the alternative, optionally such support surfaces may be formed by an insert or a cover-layer rigidly connected to the cutter element, for example in terms of a bearing insert.

According to another aspect, the pivot joint support surface of the cutter element may be provided on a cutter element spring connected to a cutter element body and elastically biasing the cutter element body against a shear foil of the shaver head. Thus, the elongated drive transmitter drives the biasing spring structure in an oscillating manner along the aforementioned cutter oscillation axis which biasing spring structure is adapted to bias the cutter element towards a shear foil and/or towards the skin to be shaved.

The pivot axis of the at least one cutter element as defined by the pivot joint may be spaced apart from the pivot axis of the shaver head frame or the entire shaver head structure. In particular, when there are more than one cutter elements, the pivot axis defined by the pivot joint may be offset from the pivot axis of the shaver head in a direction transverse to the longitudinal axis of the elongated drive transmitter and transverse to the cutter oscillation axis and/or offset in a direction substantially parallel to the elongated drive transmitter's longitudinal axis. Basically, the same kind of offset may be provided when there is only one cutter element.

More particularly, the pivot axis defined by the aforementioned pivot joint between the elongated drive transmitter and the cutter element may be further away from the shaver housing than the pivot axis of the shaver head. If the elongated drive transmitter extends from the shaver housing into the shaver head, the elongated drive transmitter may have a length longer than the distance the shaver head pivot axis is spaced apart from the shaver housing.

These and other features become more apparent from the examples shown in the drawings. As can be seen from FIG. 1, shaver 1 may have a shaver housing 2 forming a handpiece for holding the shaver, which shaver housing 2 may have different shapes such as—roughly speaking—a substantially cylindrical shape or box shape or bone shape allowing for ergonomically grabbing and holding the shaver, wherein such shaver housing has a longitudinal shaver housing axis due to the elongated shape of such housing, cf. FIG. 1.

On one end of the shaver housing 2, a shaver head 3 is attached to the shaver housing 2, wherein the shaver head 3 can be pivotably supported about a shaver head pivot axis 7 extending substantially perpendicular to the aforementioned longitudinal shaver housing axis 30. The shaver housing 2 may have a pair of support arms projecting from the shaver head end of the shaver housing 2 between which support arms a carrier structure of the shaver head 3, for example in terms of a shaver head frame 6, can be pivotably mounted about said shaver head pivot axis 7.

Figure 2:
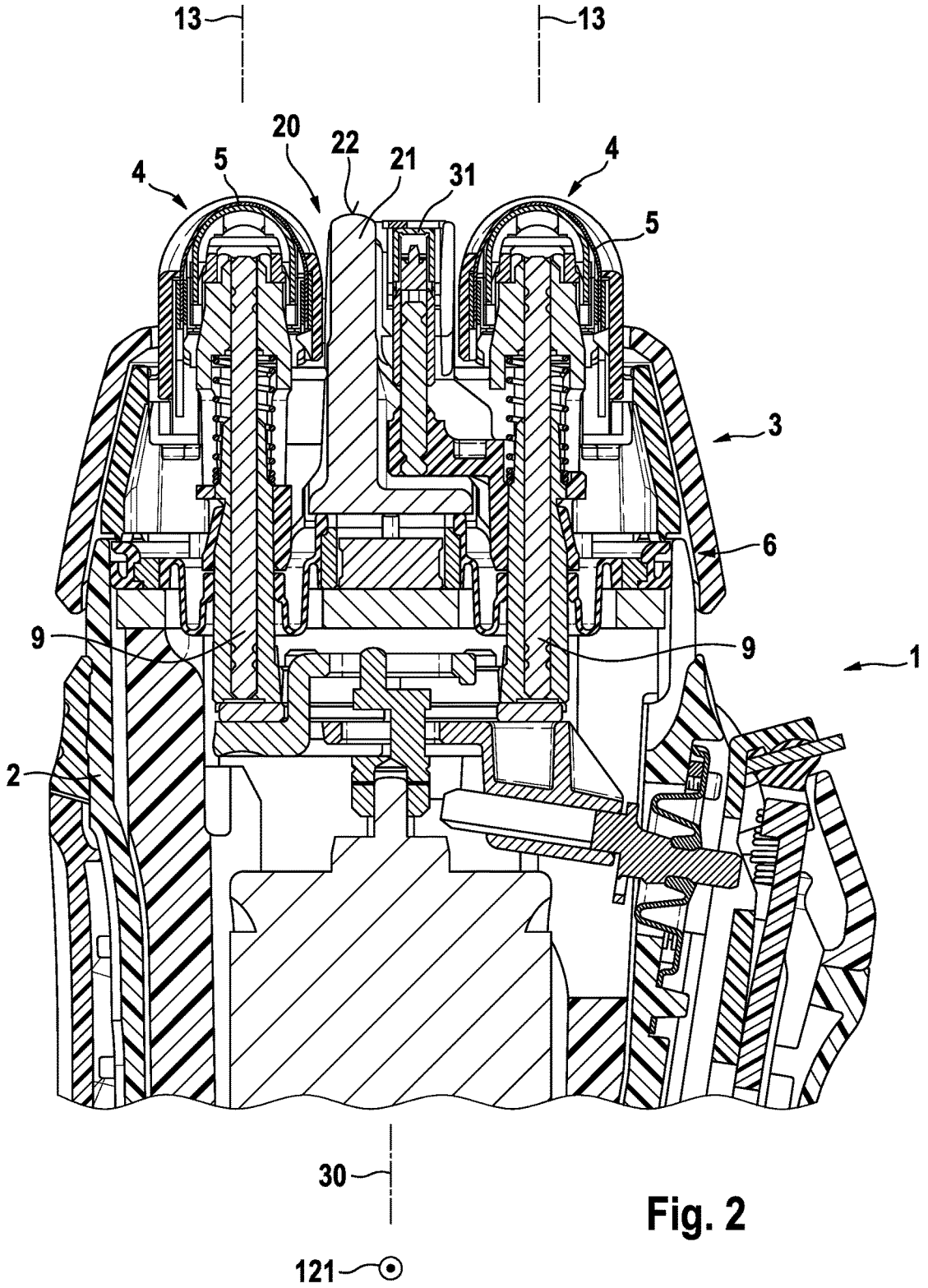
FIG. 2: shows a cross-sectional view of the shaver head in a cross-sectional plane extending perpendicular to the cutter oscillation axis and containing elongated drive transmitters for driving the cutter elements in an oscillating manner along said cutter oscillation axis, wherein said cross-sectional view shows the auxiliary function element extending between the two cutter elements towards a skin contact side of the shaver head.

As can be seen from FIGS. 1 and 2, the shaver head 3 may include a pair of cutter elements 4, wherein only one or three or more of such cutter elements 4 may be provided. Such cutter elements 4 may form block-like undercutters with a plurality of shearing blades cooperating with a shear foil 5 covering the respective cutter elements 4. The said cutter elements 4 may have an elongated shape with a longitudinal axis extending substantially parallel to the aforementioned shaver head pivot axis 7 and/or substantially parallel to the cutting oscillation axis 8 along which the cutter elements 4 are driven in an oscillating manner.

In addition to the at least one cutter element 4, the shaver head 3 includes at least one non-cutting auxiliary function element 20 which may have an applicator head 21 forming a part of the skin contact side of the shaver head 3, more particularly part of a front side of the shaver head 3 turned away from or opposite to the shaver housing 2, cf. FIG. 2.

The said applicator head 21 may have an elongated and/or plate-like configuration to extend along at least one side of at least one cutter element 4, wherein, however, other shapes and configurations are possible.

As can be seen from FIG. 2, such auxiliary function element 20 may include a thermal element such as a cooling and/or heating element having a contact surface 22 which is not covered by any shaver head housing, but can be brought into contact with the skin to be shaved.

Such contact surface 22 may extend along one side of the at least one cutter element 4, in particular along a principal side of such cutter element 4 which principal side can be the longer side of a cutter element 4 having an elongated shape. When there are two or more than two cutter elements 4, the said auxiliary function element 20 may be positioned between a pair of said plurality of cutter elements 4, wherein the contact surface 22 may extend between the contact surfaces of such pair of cutter elements 4.

The non-cutting auxiliary function element 20 may extend from the shaver housing 2 through the interior of the shaver head 3 to the side of the shaver head 3 turned away from the shaver housing 2, wherein the auxiliary function element 20 may be mounted to the shaver housing 2 and/or to a structural element of the shaver head 3. In particular, the auxiliary function element 20 may be fixedly mounted to the shaver housing 2 and/or may be held in a fixed orientation projecting from the shaver housing 2 towards the shaver head side turned away from the shaver housing 2, wherein the auxiliary function element 20 may extend substantially in parallel with the longitudinal axis 30 of the shaver housing 2. As can be seen from FIG. 1 and FIG. 2, the auxiliary function element 20 may have a rib-shaped configuration or at least a rib-shaped application head 21 extending through the shaver head 3.

The shaver head 3 may include further functional elements such as a long-hair cutter 31 which may be arranged between a pair of cutter elements 4, as can be seen from FIG. 1.

The said cutter elements 4 may be supported moveably relative to the shaver head frame 6 which is pivotably supported on the shaver housing 2 such that the cutter elements 4 may pivot with the shaver head 3 about shaver head pivot axis 7 and, in addition, may oscillate along the cutting oscillation axis 8 relative to said shaver head frame 6. In addition to these two degrees of freedom or in the alternative to pivot axis 7, the cutter elements 4 may be moveable relative to the shaver head frame 6 along and/or about additional axes. For example, the cutter elements 4 may dive into the shaver head 3, that means displaced along an axis substantially parallel to the shaver housing longitudinal axis 30 when the shaver head 3 is in a position aligned therewith. In addition or in the alternative, the cutter elements 4 may pivot relative to the shaver head frame 6 about pivot axes 11 and 12 perpendicular to each other and transverse to the longitudinal shaver housing axis 30, as will be described in detail later.

The cutter elements 4 can be driven in an oscillating manner along cutting oscillation axis 8. In addition to such cutting movements, the cutting elements 4 are pivotable and movable in directions transverse to said cutting oscillation axis 8.

More particularly, the cutter elements 4 may be supported pivotable about a pivot axis 11 extending substantially perpendicular to the shaver housing's longitudinal axis 30 and/or substantially parallel with the cutter oscillation axis 8. As can be seen from FIGS. 3 and 4*a*-4*c*, the cutter elements 4 may be supported on a common pivot frame 40 which is pivotably supported on the shaver head frame 6 about the aforementioned pivot axis 11, said pivot frame 40 having portions 40L and 40R extending on opposite sides of said pivot axis 11 so that said pivot frame 40 forms a sort of rocking yoke. A first one of the cutter elements 4 is supported on a right side portion 40R of said pivot frame 40 and a second one of said cutter elements 4 is supported on a left side portion 40L of said pivot frame 40.

The pivot axis 11 of the pivot frame 40 may extend co-axially with the aforementioned shaver head pivot axis 7 when the entire shaver head structure is pivotably supported. In the alternative, the shaver head's pivot axis 7 may be spaced apart from the pivot axis 11 of the cutter elements 4 allowing for relative pivoting of the cutter elements 4. As a further alternative, shaver head frame 6 may be held in fixed orientation relative to the shaver housing 2 so that there is no shaver head pivot axis 7, but pivoting of the cutter elements 4 is allowed by pivot axis 11 only.

Figures 4A, 4B, 4C:
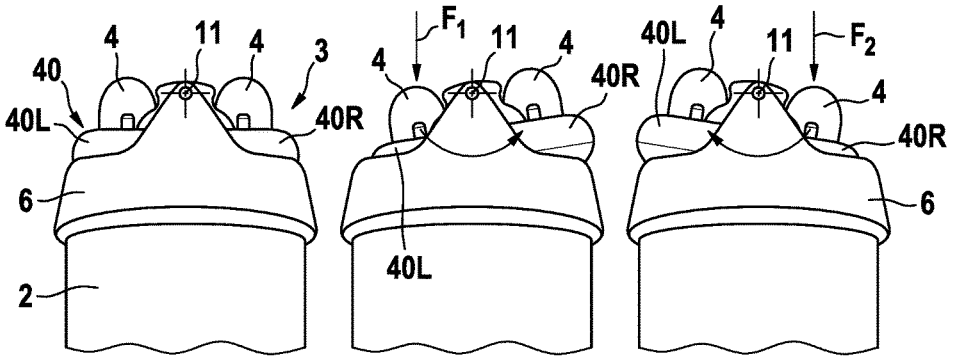
FIG. 4*a*: shows a side view of the shaver head of FIG. 3, in particular showing the cutter elements in an initial or basic position not yet pivoted to any side.
FIG. 4*b*: shows a side view of the shaver head of FIG. 3, in particular showing the cutter elements in a counter-clockwise pivoted position due to skin contact pressure onto a left cutter element and view.
FIG. 4*c*: shows a side view of the shaver head of FIG. 3, in particular showing the cutter elements in a clockwise pivoted position due to skin contact pressure onto a right cutter element.

As can be seen from FIG. 4*a*, the aforementioned common pivot frame 40 effects pivoting of the cutter elements 4 in response to each other. When, e.g., a left side portion 40L of pivot frame 40 is forced downwards by means of skin contact pressure as symbolized by arrow F1 in FIG. 4*b*, the right side portion 40R of pivot frame 40 moves upwards. In other words, both pivot frame portions 40R and 40L of pivot frame 40 and thus, the cutter elements 4 supported thereon may pivot in the same angular orientation and/or the same angular amount. For example, as shown by FIG. 4*c* and FIG. 5, if a right side portion 40R of pivot frame 40 pivots in the clockwise direction by an angle $\alpha$ of, e.g., 10 degrees, then also the left side portion 40L of pivot frame 40 pivots in the clockwise direction by 10 degrees.

Figure 5:
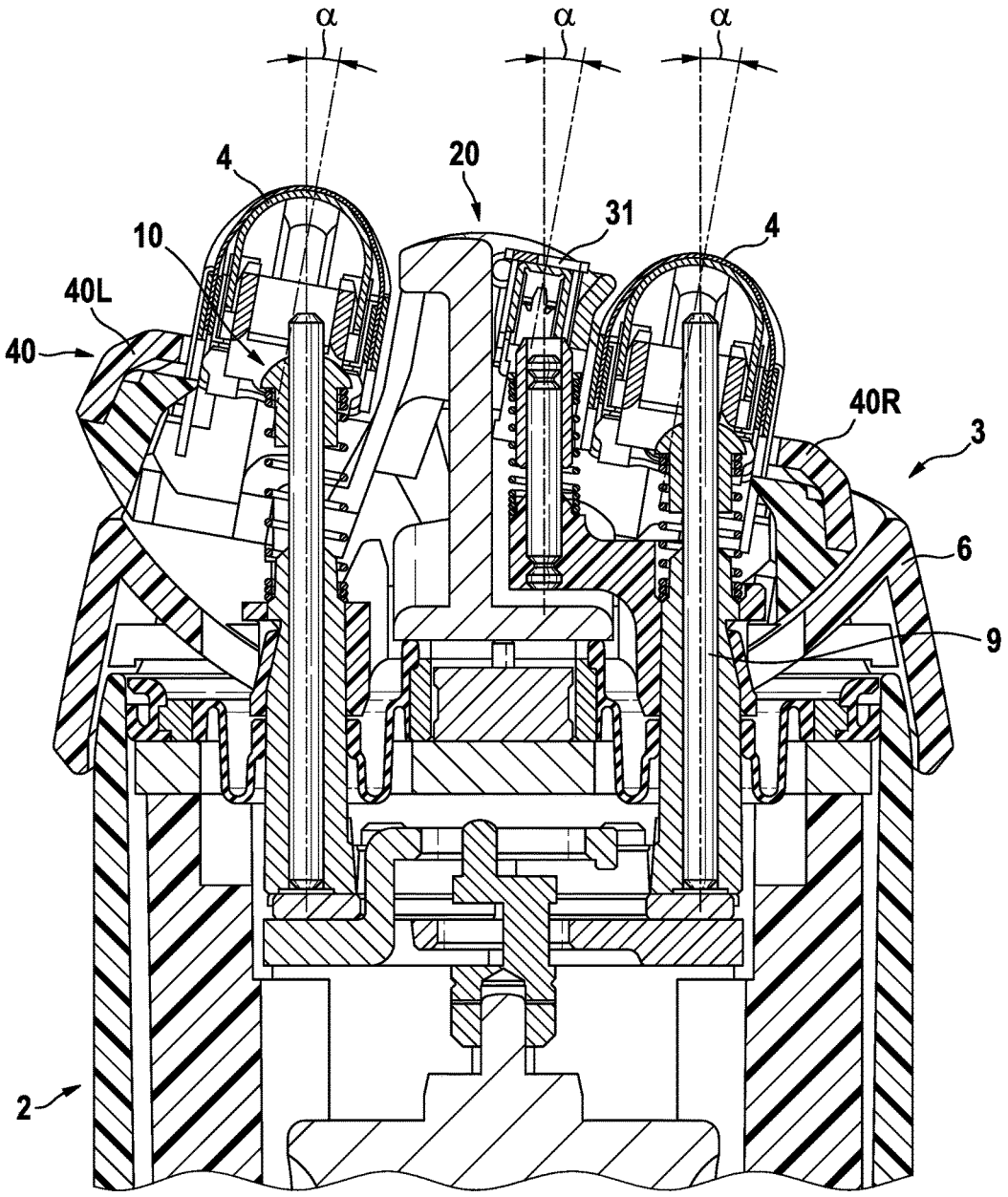
FIG. 5: a cross-sectional view through the shaver head of FIGS. 3 and 4*a* to 4*c* in a cross-sectional plane perpendicular to the cutter oscillation axis and perpendicular to the pivot axis of the cutter elements, wherein the two cutter elements and the long hair cutter are shown in a clockwise pivoted position with all cutters having the same pivot angle relative to the auxiliary function element.

As shown by FIG. 5, also long hair cutter 31 may be supported on the common pivot frame 40 so that also the long hair cutter 31 executes a corresponding pivotal movement, i.e. also the long hair cutter 31 is pivoted in the same clockwise or counter-clockwise direction by the same angle. In contrast, the auxiliary function element 20 does not follow such pivoting movement, but maintains its set angular orientation.

Figure 3:
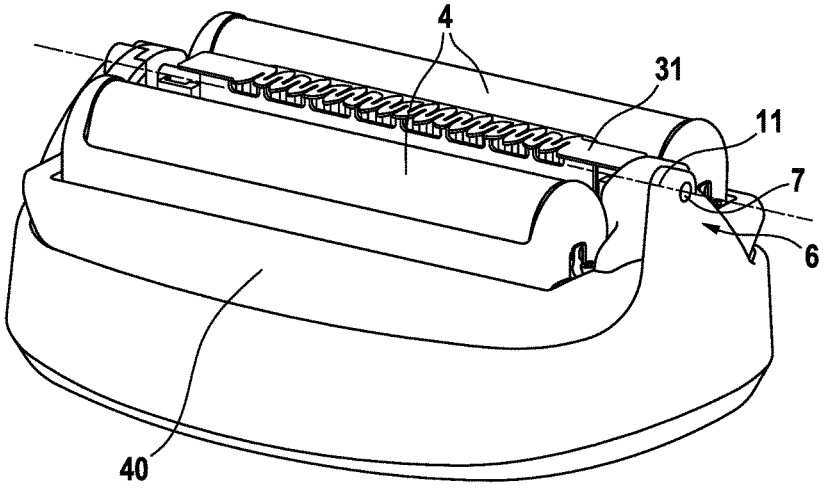
FIG. 3: a perspective partial view of the shaver head illustrating the arrangement of the pivot axis of a pivot frame supporting two cutter elements and a long hair cutter to allow for joint pivoting of the two cutter elements and the long hair cutter relative to the auxiliary function element.

Supporting the cutter elements 4 on a common pivot frame 40 as shown by FIGS. 3 to 5, allows for a simple support structure and evenly distributes the contact pressure onto the plurality of cutter elements 4.

As can be seen from FIG. 4*a*, the pivot frame 40 may be biased into an intermediate, initial or basic position, e.g. by means of springs acting between the pivot frame 40 and the shaver head frame 6. Such springs may include simple spiral springs or torsion springs or other suitable spring configurations.

Figure 6:
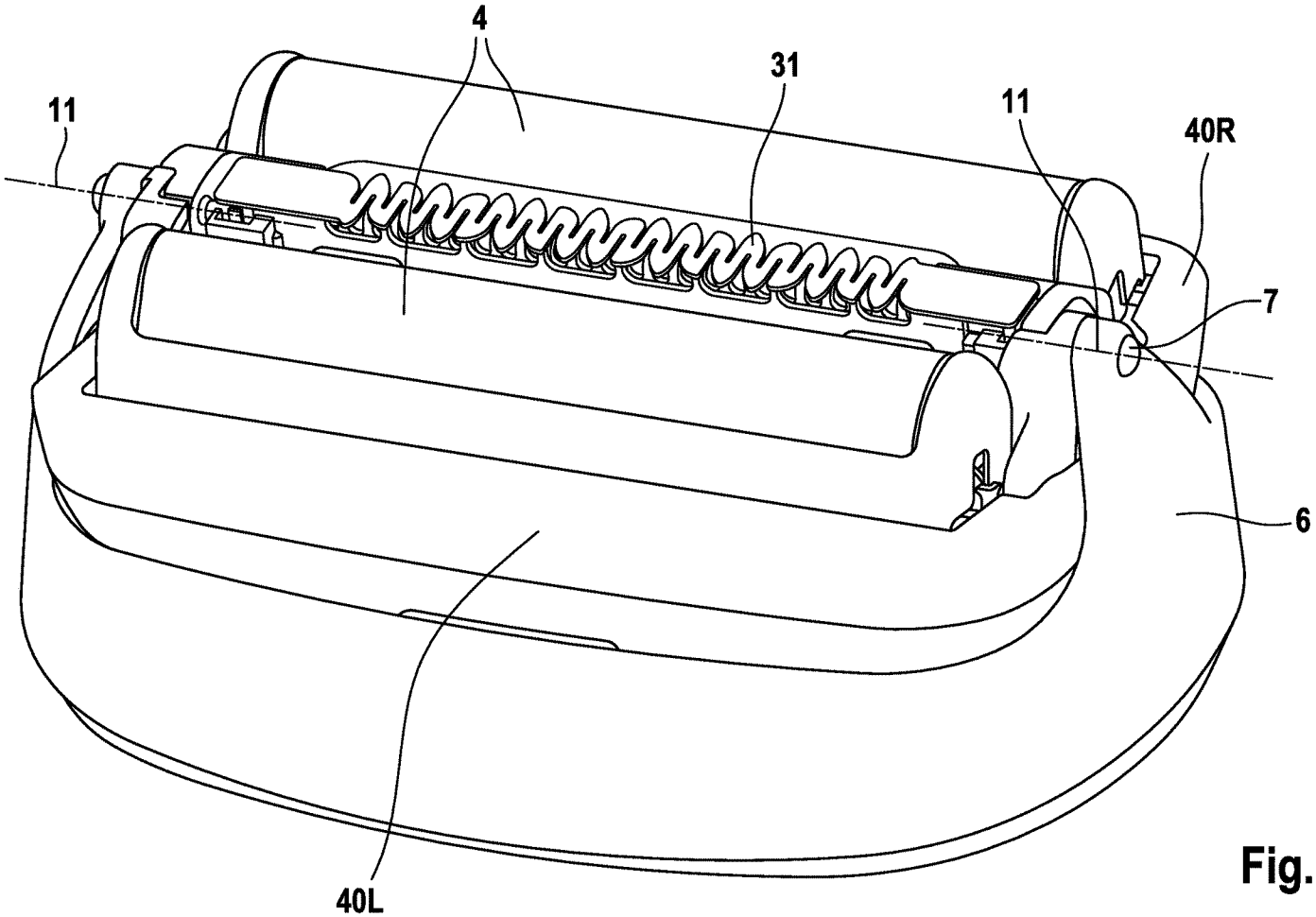
FIG. 6: shows a schematic perspective view of a shaver head having cutter elements pivotably supported independently from each other allowing for independent pivoting of the cutter elements, in a perspective view similar to FIG. 3, FIG. 7*a*: shows a side view of the shaver head of FIG. 6, in particular showing the cutter elements in an upper initial or basic position.
Figure 7A:
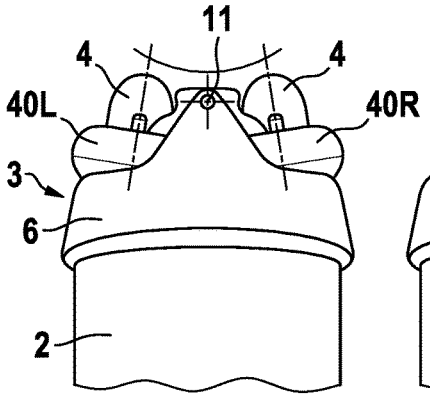
FIG. 7*b*: shows a side view of the shaver head of FIG. 6, in particular showing the cutter elements in a lower end position or a lower diving position where the two cutter elements, in comparison to the basic position of view (7*a*), have pivoted in angular directions opposite to each other.
FIG. 7*c*: shows a side view of the shaver head of FIG. 6, in particular showing the cutter elements each pivoted in a clockwise direction to adjust to an inclined skin surface.
FIG. 7*d*: shows a side view of the shaver head of FIG. 6, in particular showing the cutter elements in a working position where the two cutter elements have been pivoted in angular directions contrary to each other to adapt to a skin contour substantially perpendicular to the longitudinal axis of the shaver.
FIG. 7*e*: shows a side view of the shaver head of FIG. 6, in particular showing the cutter elements each pivoted in a counter-clockwise direction to adapt to an inclined skin contour.
FIG. 7*f*: shows a side view of the shaver head of FIG. 6, in particular showing the cutter elements in an upper end position or basic position similar to view (7*a*), wherein the two cutter elements are pivotably supported about separate pivot axes extending substantially parallel to each other, but spaced apart from each other.
FIG. 7*g*: shows a side view of the shaver head of FIG. 6, in particular showing the left cutter element in its upper end position or basic position similar to view (7*a*) and a right cutter element in an intermediate position similar to view (7*d*), and, FIG. 7*h*: shows a side view of the shaver head of FIG. 6, in particular showing the left cutter element in an intermediate position similar to view (7*d*) and a right cutter element in an upper end position or basic position similar to view (7*a*)
Figure 7B:
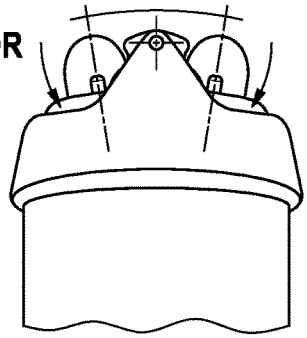
Figure 7C:
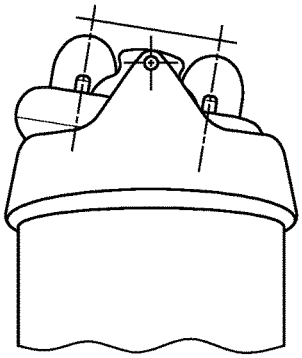
Figure 7D:
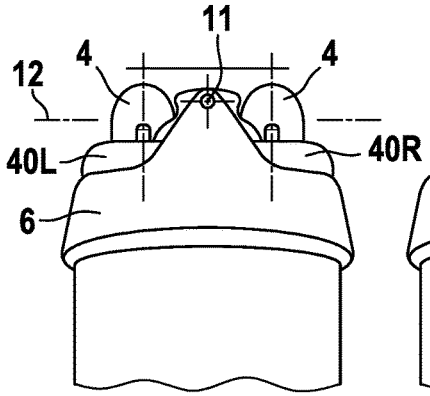
Figure 7E:
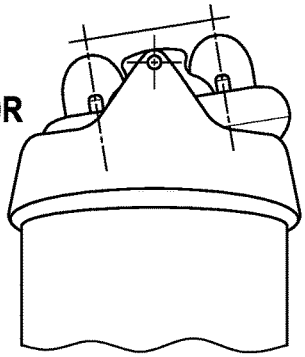
Figure 7F:
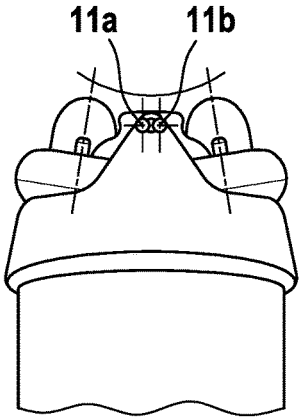
Figure 7G:
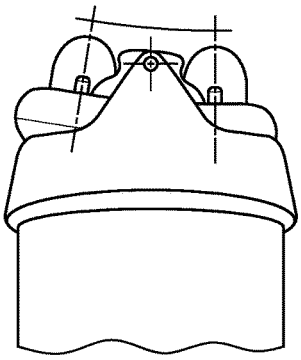
Figure 7H:
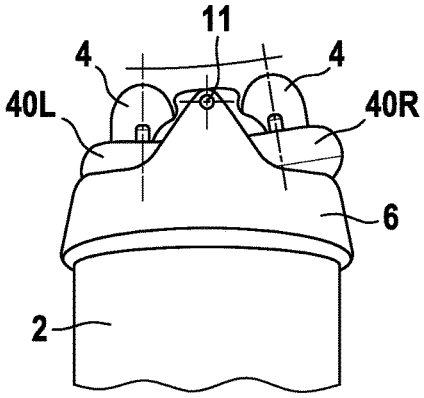
Figure 8C:
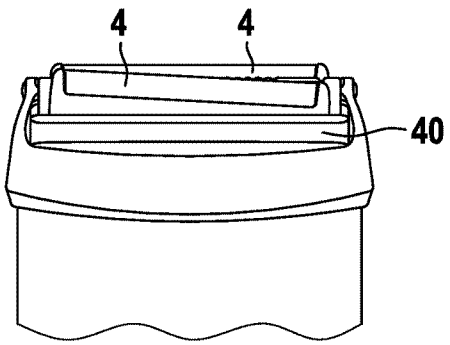
FIG. 8*c*: shows the shaver head shown in FIG. 8*a* with the cutter element in a clockwise pivoted position.
Figure 8B:
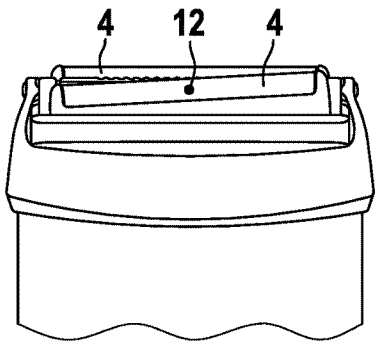
FIG. 8*b*: shows the shaver head shown in FIG. 8*a* with the cutter element in a counter-clockwise pivoted position.
Figure 8A:
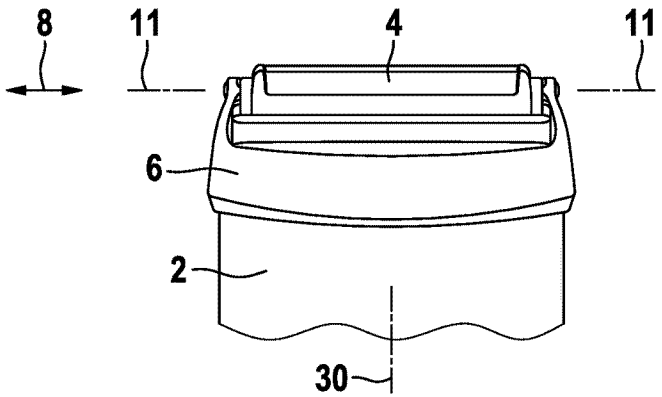
FIG. 8*a*: shows a side view of a shaver head in a viewing direction substantially perpendicular to the cutter oscillation axis, the shaver's cutter elements having an additional pivot axis extending substantially perpendicular to the cutter oscillation axis and perpendicular to the shaver housing's longitudinal axis, showing the cutter element in a basic or initial position.
Figure 8E:
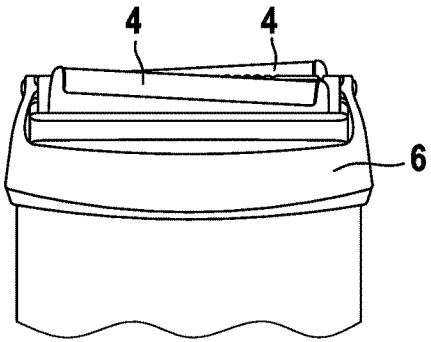
FIG. 8*e*: shows the shaver head in FIG. 8*a* with the front side cutter element and the rear side cutter element in different angular positions after pivoting in angular directions contrary to each other.
Figure 8D:
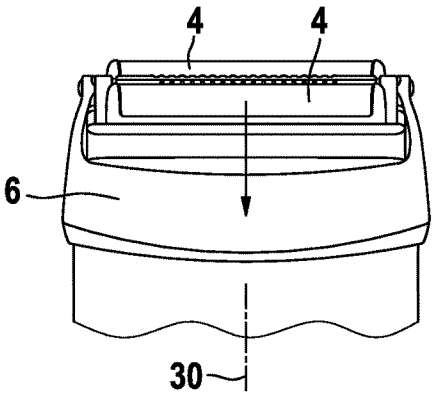
FIG. 8*d*: shows the shaver head shown in FIG. 8*a* with the front side cutter element in a lower end position or diving position.
Figure 9:
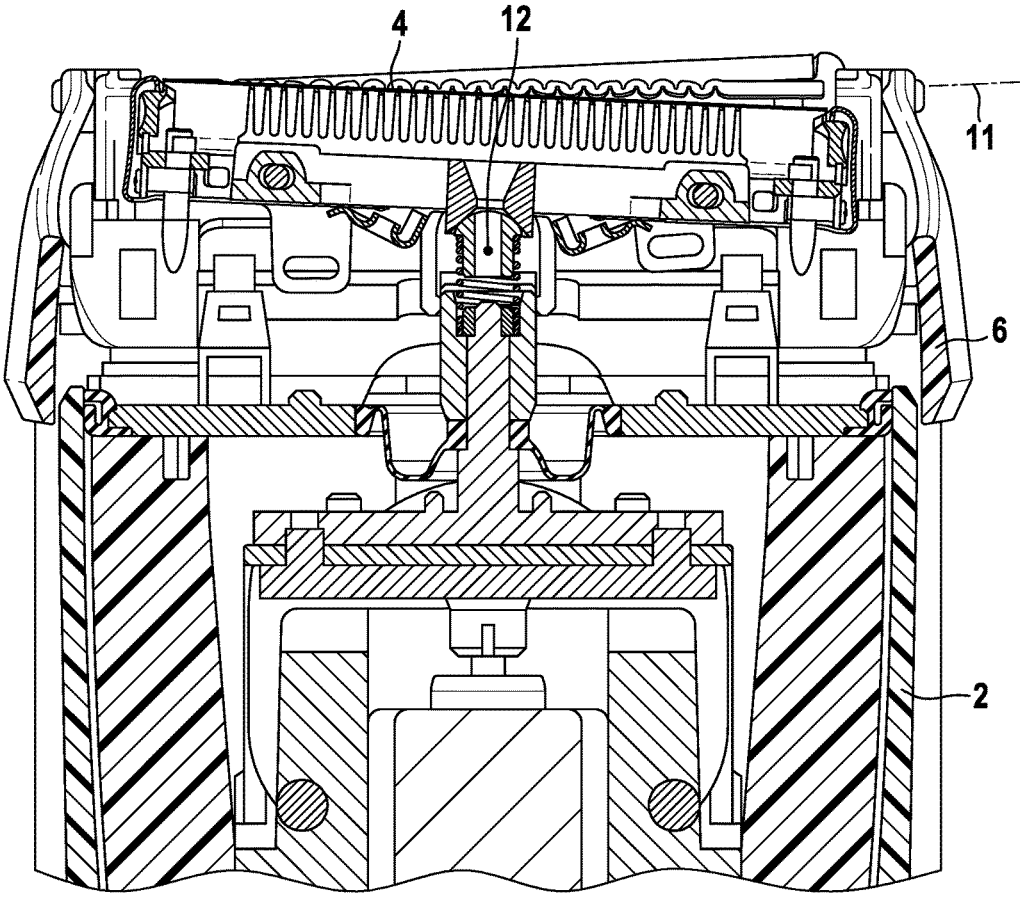
FIG. 9: shows a cross-sectional view of the shaver head of FIGS. 8*a*-8*e* in a cross-sectional plane substantially parallel to the cutter oscillation axis and perpendicular to the addition pivot axis illustrated by the different views of FIG. 8, FIG. 10*a*: shows a cross-sectional view of the shaver head of FIGS. 6-9 in a cross-sectional plane perpendicular to the cutter oscillation axis and containing the elongated drive transmitters for driving the cutter elements in an oscillating manner, in particular showing the cutter elements in an upper end position or initial position with opposite inclinations relative to the auxiliary function element.

In the alternative to a common pivot frame 40 for both cutter elements 4, there may be separate pivot frames or separate pivot frame portions 40R and 40L for the cutter elements 4. Such separate pivot frames 40R, 40L as shown in FIGS. 6 and 7*a*, may pivot independently from each other about a pivot axis 11 extending substantially parallel to the cutter oscillation axis 8. As can be seen from FIG. 7*a*, the pivot frames 40R and 40L may be supported on a common pivot axis 11 or, in the alternative, may be supported on separate pivot axes 11*a* and 11*b* spaced from each other and extending substantially parallel to each other, as it is shown by view (f) of FIG. 7. Nevertheless, also in case where the two pivot frames 40R and 40L are supported on a common pivot axis 11, the pivot frames 40R and 40L may pivot independently from each other.

The pivot frames 40R and 40L can be biased towards an initial or basic position as it is shown in view (a) of FIG. 7. Such starting or initial position may be an upper end position towards which the pivot frames 40R and 40L may be independently from each other biased by means of, e.g., springs having a suitable configuration as mentioned before.

Figure 10B:
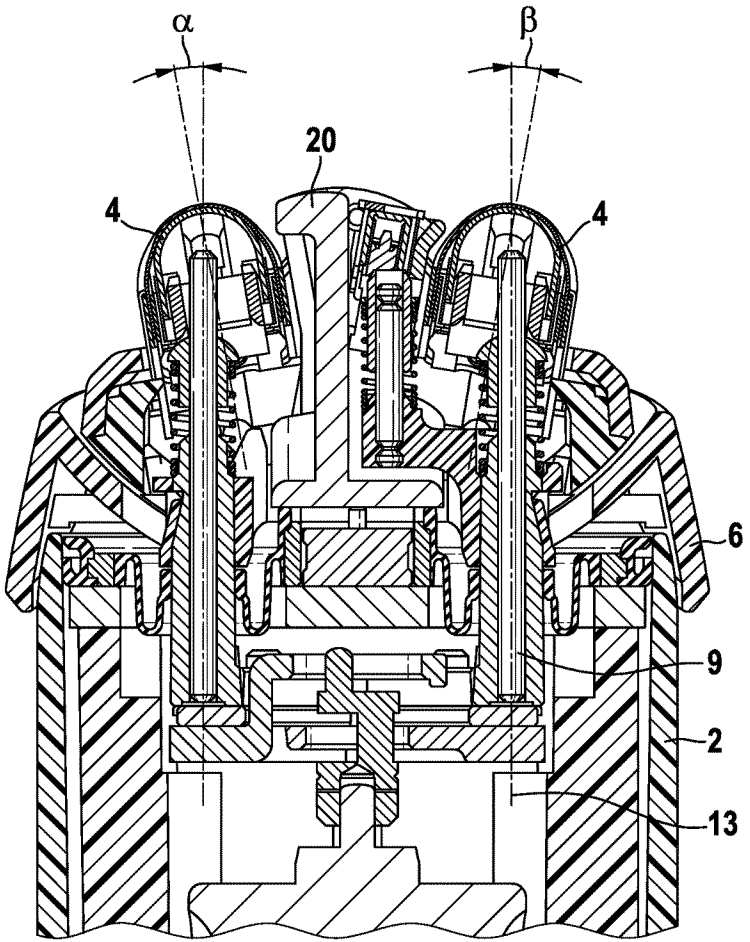
FIG. 10*b*: shows a cross-sectional view of the shaver head of FIGS. 6-9 in a cross-sectional plane perpendicular to the cutter oscillation axis and containing the elongated drive transmitters for driving the cutter elements in an oscillating manner, in particular showing the cutter elements in their lower end position again having opposite inclinations relative to the auxiliary function element.
Figure 10A:
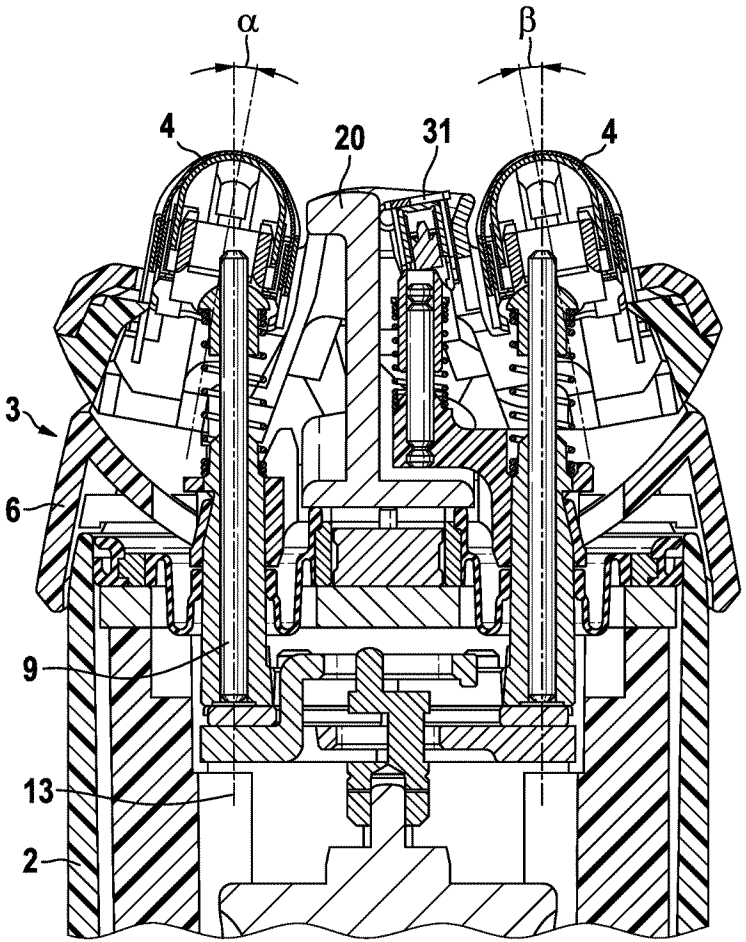
Figure 11:
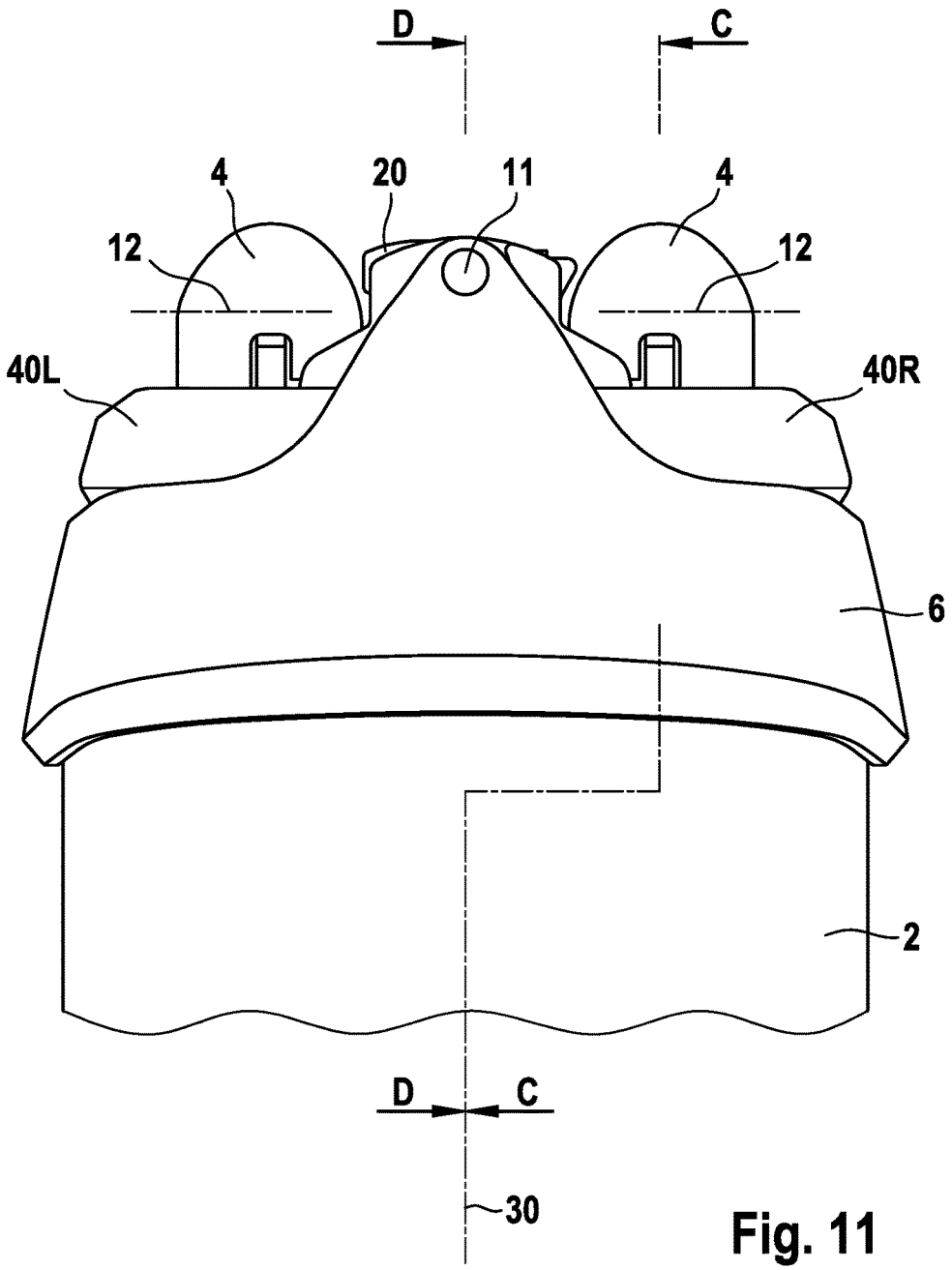
FIG. 11: a side view of the shaver head of FIGS. 10*a*-10*b* in a viewing direction parallel to the cutter oscillation axis.
Figure 12:
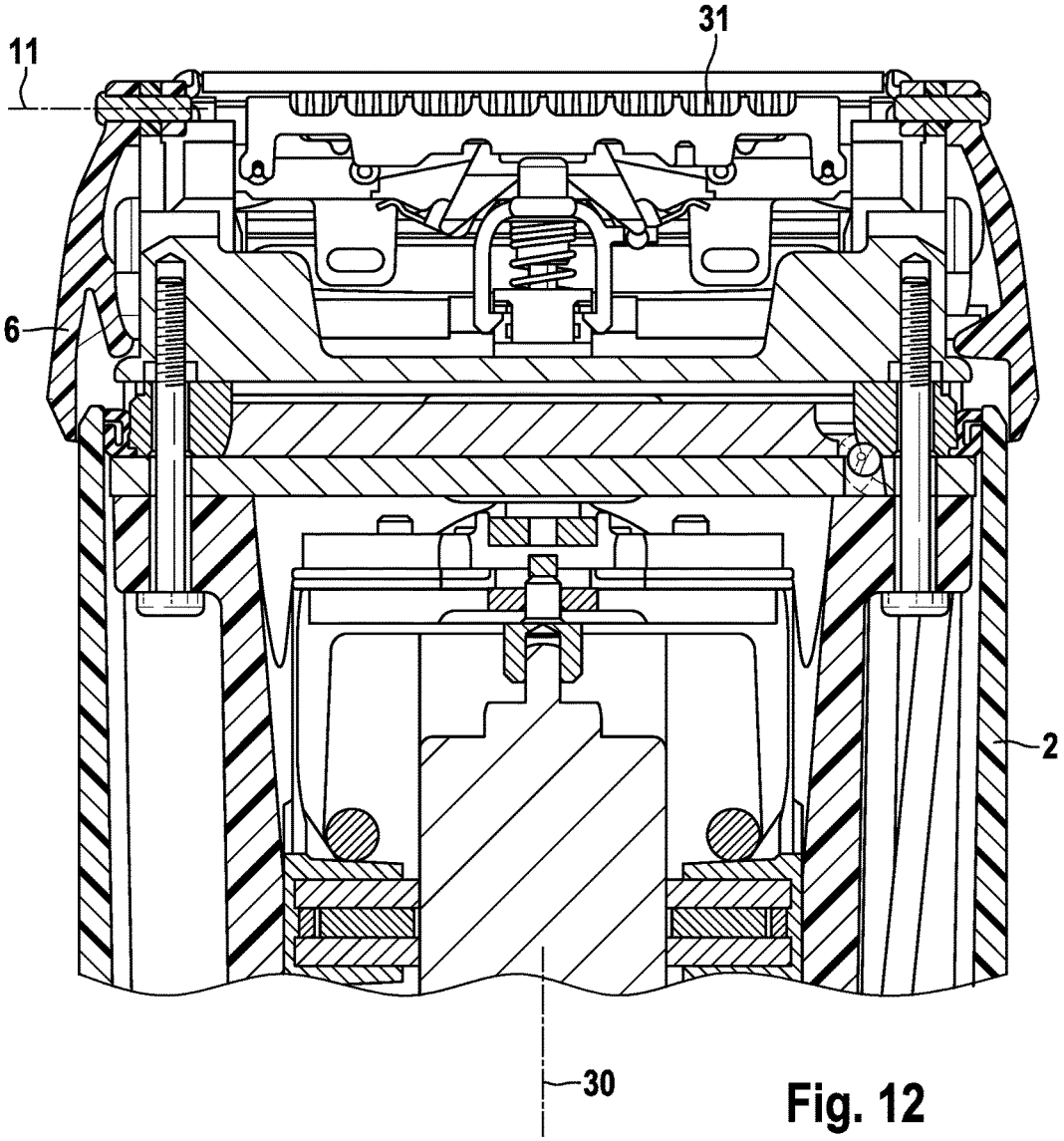
FIG. 12: a cross-sectional view of the shaver head of FIG. 11 along a line D-D in FIG. 11 going through the longitudinal shaver housing axis to illustrate the long hair cutter structure.

As illustrated by FIGS. 7*a* to 7*h*, the pivot frames 40R and 40L and thus, the cutter elements 4 supported thereon may pivot about pivot axis 11 independently from each other into various positions relative to each other, thereby allowing for individual adaption of the cutter element positioned to the skin contour. For example, the separate pivot frames 40R and 40L may pivot in a way similar to the common pivot frame 40 shown in FIG. 4, cf. views (c) and (e) of FIG. 7, but in addition the pivot frames 40R and 40L also may pivot in opposite angular directions or it is possible that only one pivot frame executes pivotal movement, whereas the other does not, cf. also FIGS. 10*a* and 10*b* and the angles $\alpha$ and $\beta$ shown therein.

As illustrated by FIGS. 8*a* to 8*e* and 9, the cutter elements 4 may have an additional degree of freedom. More particularly, the cutter elements 4 may pivot about a pivot axis 12 extending substantially perpendicular to the cutter oscillation axis 8 and substantially transverse to the shaver housing's longitudinal axis 30. Such addition degree of freedom may be achieved, e.g., by means of movably supporting the cutter elements 4 on the pivot frames or pivot frame portions 40R and 40L. For example, the cutter elements 4 may be supported on their pivot frames via a spring arrangement comprising, e.g., spring elements forcing the cutter elements 4 upwards away from the pivot frame 40. Such spring support structure between pivot frames 40 and cutter elements 4 allows the cutter elements 4 to pivot relative to the pivot frames 40 about the aforementioned pivot axis 12. Such additional pivotal degree of freedom about pivot axis 12 can be implemented into the example shown in FIGS. 3 to 5 where the cutter elements 4 are supported on a common pivot frame 40 and also implemented into the example shown in FIGS. 6, 7 and 10 where the cutter elements 4 are supported on separate pivot frames 40R and 40L.

As can be seen from FIGS. 8*a* to 8*e*, the cutter elements 4 may pivot about said pivot axis 12 independently from each other. For example, only one of the cutter elements 4 may pivot as shown in views (b) and (c) of FIG. 8, or each of the cutter elements 4 may pivot about said pivot axis 12 as shown in view (e) of FIG. 8, wherein the cutter elements 4 may pivot into the same angular direction or into opposite directions and/or by the same angle or by different angles.

In addition to such pivoting about pivot axis 12, the cutter elements 4 also may be displaced in a linear fashion. For example, the cutter elements 4 may dive along a diving axis extending substantially parallel to the shaver housing's longitudinal axis 30. Such diving may be executed by both cutter elements 4 at the same time as shown by view (d) of FIG. 8 or it is also possible that only one of the cutter elements 4 executes such diving. The cutter elements 4 may be displaced along at least one linear axis independently from each other.

As can be seen from FIG. 2, each cutter element 4 can be driven in said oscillating manner by means of an elongated drive transmitter 9 extending from the shaver housing 2 into the shaver head 3 up to the cutter element 4. Such elongated drive transmitter 9 may form a rigid drive pin extending from the interior of the shaver housing 2 to the exterior of the shaver housing 2, that means through an outer shell of the shaver housing 2, if the drive unit includes a motor accommodated within the shaver housing 2. Such motor may be a rotatory electric motor or a magnetic-type linear motor connected to the drive pin in a suitable manner.

The said elongated drive transmitter 9 is held in a fixed orientation relative to the shaver housing 2, wherein in particular the elongated drive transmitter 9, with its longitudinal axis 13, may extend substantially parallel to the longitudinal shaver housing axis 30.

There may be two elongated drive transmitters 9 when there are two cutter elements 4, such elongated drive transmitters 9 extending in parallel to each other, or more than two elongated drive transmitters 9 when there are more than two cutter elements 4.

The elongated drive transmitters 9 are each driven by the aforementioned drive unit's motor to oscillate uniaxially relative to the shaver housing along an axis 121 perpendicular to the longitudinal axis 13 of the elongated drive transmitter 9 and substantially parallel to the longitudinal extension of the elongated cutter elements 4, cf. FIGS. 4*a* to 4*c* and 5.

The elongated drive transmitter 9 may extend from the shaver housing 2 into the cutter element 4 so that the projecting end of the elongated drive transmitter 9 extends within an interior space provided in the cutter element 4.

Figure 14C:
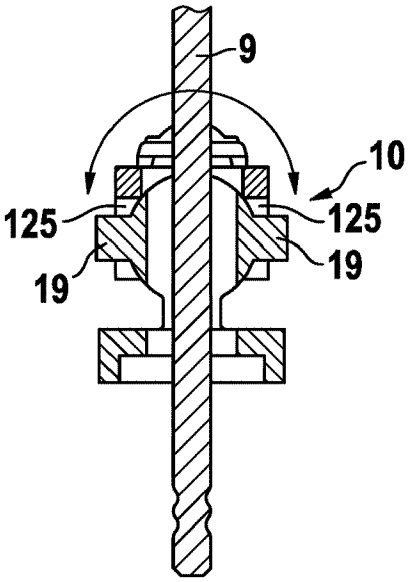
FIG. 14*c*: shows a pivot connection between the elongated drive transmitter and a cutter element in further detail, in particular showing a cross-section of the pivot joint in a plane containing the elongated drive transmitter and transverse to the axis of oscillation.
Figure 14B:
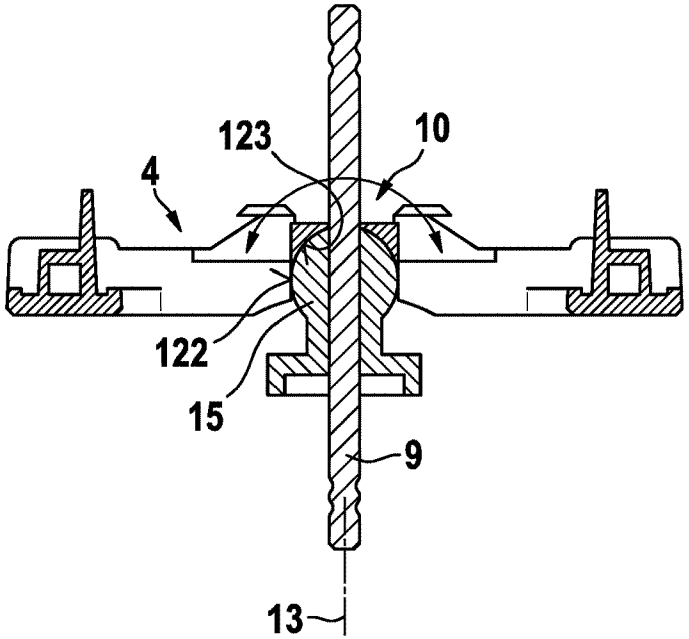
FIG. 14*b*: shows a pivot connection between the elongated drive transmitter and a cutter element in further detail, in particular showing a cross-section of the pivot joint in a plane containing the elongated drive transmitter and parallel to the oscillation axis.

As can be seen from FIGS. 5, 14*a* to 14*c* and 15*a* and 15*b*, the elongated drive transmitter 9 is coupled to the cutter element 4 by means of a pivot joint 10 which may include a block-shaped or sleeve-like connector 15 forming a ball-joint piece engaging with the cutter element 4, as shown in FIG. 14*b*. Said ball-joint piece may be a hard plastic element or made from other resistive bearing materials such as metal. The said connector 15 directly connects an end portion of the elongated drive transmitter 9 to the cutter element 4, wherein said end portion of the elongated drive transmitter 9 may be received in said connector piece 15 mounted to the cutter element 4.

As can be seen from FIG. 14*b*, the connector 15 may have a transmitter recess 17 that may be formed as an elongated, slot-like hole allowing to slide the connector 15 onto the elongated drive transmitter 9.

The connector 15 can be provide with a spherical support surface 122 which may form a spherical cap or a hemisphere or almost a complete sphere. The cutter element 4 is provided with a corresponding spherical support surface 123 cooperating and engaging with the spherical support surface 123 of the ball-joint piece mounted on the elongated drive transmitter 9. The spherical support surface 122 of the connector 15 may be formed convex or as an outer surface, whereas the spherical support surface 123 of the cutter element 4 may be formed concave or as an inner support surface. Basically, a contrary configuration with the connector's support surface 122 being concave and the cutter element's support surface 123 being convex is possible. Due to the dimensions of the cutter element 4 and the elongated drive transmitter 9, the aforementioned configuration with convex support surface 122 on the drive transmitter side and the concave support surface on the cutter element side allows for a more space-saving, compact configuration.

The said spherical support surface 123 of the cutter element 4 may be formed directly by body walls of the cutter element. In the alternative, the cutter element may include a support or bearing insert or attachment which is fixedly attached to the cutter element 4 and which forms the said spherical support surface 123.

The said spherical support surfaces 122 and 123 snuggly fit onto each other so that the connector 15 is held at the cutter element 4 without play, at least in the direction of the cutter oscillation axis 8 along which the cutter element 4 is driven in an oscillating manner, such cutter oscillation axis 8 being substantially parallel to the drive axis 121 of the elongated drive transmitter 9. More particularly, the connector 15, due to the spherical support surfaces 122 and 123, may pivot relative to the cutter element 4 about pivot axes 11 and 12 extending perpendicular to each other and perpendicular to the longitudinal axis 13 of the elongated driver transmitter 9. The said pivot axes 11 and 12 can be seen from FIG. 3 and substantially extend through a center portion of the head of connector 15, more particularly through the center of curvatures of the spherical support surfaces 122 and 123.

In a direction substantially parallel to the aforementioned cutter oscillation axis 8, the elongated drive transmitter 9 is rigidly, undisplaceably received within the transmitter recess 17 of connector 15 and thus, the elongated drive transmitter 9 is exactly held in position relative to the cutter element 4. In other words, along the cutter oscillation axis 8, no relative movement of the cutter element 4 to the elongated drive transmitter 9 is possible and the cutter element 4 instantaneously follows any movement of the elongated drive transmitter 9 in said direction of the cutter oscillation axis 8 without play.

Figure 14A:
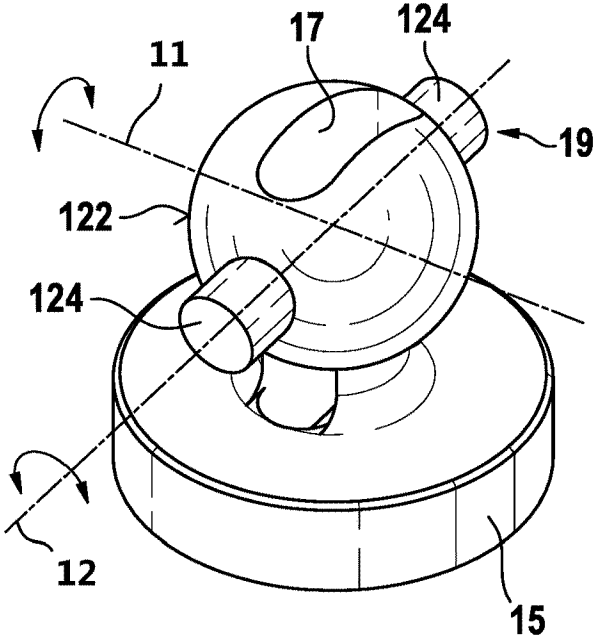
FIG. 14*a*: shows a pivot connection between the elongated drive transmitter and a cutter element in further detail, in particular showing a perspective view of a ball joint piece having a spherical support surface.

In a direction transverse to said cutter oscillation axis 8 and transverse to the longitudinal axis 13 of the elongated drive transmitter 9, there is, however, play and the elongated drive transmitter 9 may move relative to the cutter element 4. According to the example shown in FIG. 14*b*, such degree of freedom of the cutter element 4 relative to the elongated drive transmitter 9 in the aforementioned transverse direction, is achieved by means of the elongated, slot-like contour of the transmitter recess 17 formed in the connector 15. As shown by FIG. 14*a*, the length of the slot-like hole forming the transmitter recess 17 is considerably larger than the diameter or thickness of the elongated drive transmitter 9. For example, the length of the slot-like transmitter recess 17 may be at least 150% of the thickness of the elongated drive transmitter 9, wherein it is also possible to have a slot length of 200% or 300% or more of the thickness of said elongated drive transmitter 9.

As can be seen from view (b) of FIG. 14, the width of said elongated slot-like hole of the transmitter recess 17 more or less exactly corresponds to the thickness of the drive transmitter 9 such that the elongated drive transmitter 9 may move only along the length direction of said slot.

The angular orientation of the slot-like hole of the transmitter recess 17, that means the angular orientation of the connector 15 is controlled by means of a rotation preventer portion 19 of said connector 15 which rotation preventer portion 19 prevents rotation of the connector relative to the cutter element 4 about an axis substantially parallel to the longitudinal axis 13 of the elongated drive transmitter 9. More particularly, the connector 15 may be provided with projecting and/or recessed engagement portions 124 arranged on opposite sides of the head of the ball-joint piece of connector 15 which projecting engagement portions 124 are received in slot like recesses formed on opposite sides of the spherical support surface 123 of the cutter element 4. The said projection portions 124 may be arranged in a plane defined by the lengthwise extension of the slot-like hole of the transmitter recess 17. As can be seen from view (a) of FIG. 14, the projecting portions 124 of the rotation preventer are aligned with the longitudinal access of said slot of the transmitter recess 17 and/or aligned with the pivot axis 12 defined by the pivot joint 10 and extending transverse to the cutter oscillation axis 8 and the longitudinal axis 13 of the elongated drive transmitter 9.

The said projecting portions 124 projecting from the spherical support surface 122 of the connector 15 may form axial stubs to allow for rotation of the connector 15 about pivot axis 12 relative to cutter element 4.

As can be seen from view (c) of FIG. 14, the recessed portion 125 formed in the spherical surface 123 of the cutter element 4 in terms of a slot-like, elongated hole allows for movements of the connector 15 relative to the cutter element 4, in particular in terms of pivoting movements about pivot axis 12 extending substantially parallel to the cutter oscillation axis 8 and substantially perpendicular to the aforementioned other pivot axis 11. Thus, when shaver head 3 pivots about shaver pivot axis 7, connector 15 may move with the respective cutter element 4 executing the aforementioned shaver head pivotal movement, wherein misalignment of the cutter element 2 and the connector 15 relative to the elongated drive transmitter 9 is compensated.

Shaver head 3 including cutter element 4 may pivot relative to the elongated drive transmitter 9 held in fixed angular orientation. Due to such shaver head pivotal movements, there can be relative movements of the connector 15 relative to elongated drive transmitter 9, wherein said elongated drive transmitter 9 slides within the aforementioned slot-like hole of the transmitter recess 17.

The connector 15 does not necessarily have spherical support surfaces, but may have a cylindrical or box-like or block-like shape, wherein the connector 15 may have rotation preventer portions 19 in terms of axial stub-like projections 124 which serve as pivot axes. In other words, the connector 15 is held with their projecting portions 124 at the cutter element 4 and may pivot relative to said cutter element 4 about said projecting portions 124 forming axial stubs. Said projecting portions 124 may extend to opposite sides and may be aligned with the aforementioned transverse axis 11 of pivot joint 10.

Figure 15B:
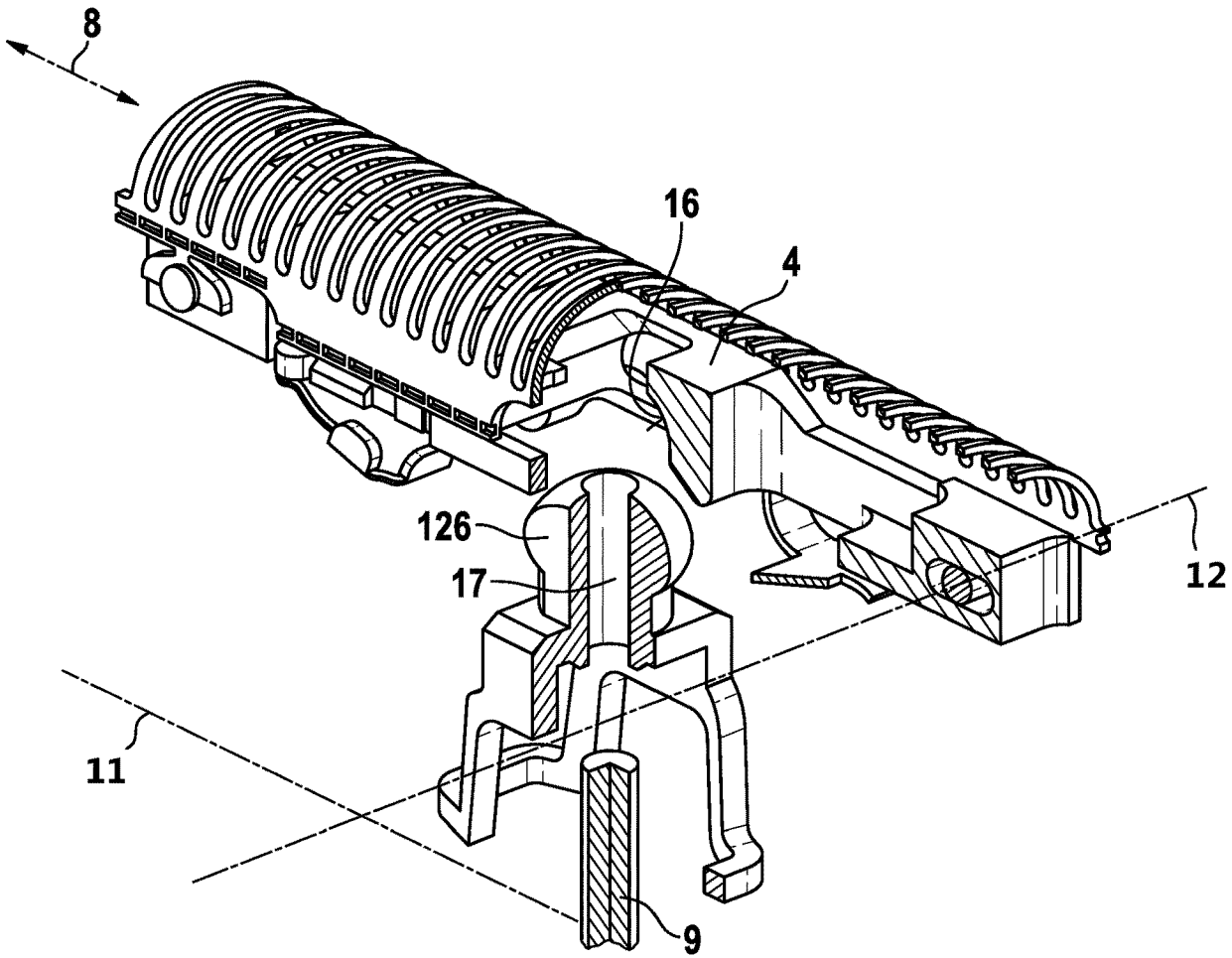
FIG. 15*b*: shows an exploded, perspective view of a pivot joint having a ball joint piece with a spherical support surface having flattening or bevelment portions providing for play of the connector piece relative to the cutter element, in particular showing the connector piece as a whole.
Figure 15A:
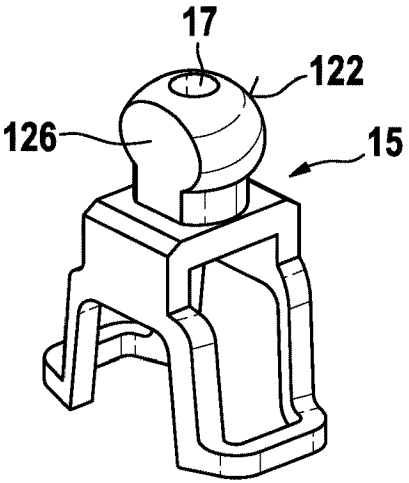
FIG. 15*a*: shows an exploded, perspective view of a pivot joint having a ball joint piece with a spherical support surface having flattening or bevelment portions providing for play of the connector piece relative to the cutter element, in particular showing the connector piece in a partly cross-sectional view relative to the cutter element and the elongated drive transmitter.

As can be seen from FIG. 15*a*, the connector 15 also may be rigidly fixed to the elongated drive transmitter 9, wherein the connector 15 of the example shown in FIG. 15*a* may be provided with spherical support surfaces 122 similar to the example shown in FIGS. 2 to 5. Such spherical support surfaces 122 engage with corresponding spherical support surfaces 123 of cutter element 4.

The transmitter recess 17 of connector 15 may have a cross-section basically corresponding to the cross-section of the elongated drive transmitter, wherein the transmitter recess 17 may be formed as a cylindrical hole receiving cylindrical drive transmitter 9. Thus, the connector 15 is fixedly mounted onto the elongated drive transmitter 9 to exactly follow any movement of the elongated drive transmitter 9 in directions transverse to the longitudinal axis 13 of the drive transmitter 9.

As can be seen from FIG. 15*a*, the connector 15 is provided with flattening portions or bevelment portions 126 in the spherical support surface 122. Such flattening portions 126 may extend on opposite sides of the connector 15, in particular on sides of connector 15 facing the transversely extending pivot axis 11. Such flattening portions 126 provide for play against the support surface of the interior transmitter recess 16 of the cutter element 4 and allows for pivoting and or displacement of the cutter element 4 relative to the connector 15 and thus to the elongated drive transmitter 9 in a plane containing the elongated drive transmitter as longitudinal axis 13 and the aforementioned transversely extending pivot axis 11.

Due to the aforementioned flattening portions 126, the head of connector 15 may be formed as a sort of plate portion having parallels, flat side faces and a curved, in particular spherically-contoured surface there between.

As can be seen from FIGS. 15*a* and 15*b*, the flattened portions 126 may be aligned with the cutter oscillation axis 8 and with the longitudinal axis 13 of elongated drive transmitter 9.

The spherically-contoured surfaces of the connector 15 are facing the direction of the cutter oscillation axis 8 and snuggly fit into the respective spherically contoured surfaces 123 of the cutter element 4. Thus, along the oscillation axis 8, the cutter element 4 follows the movements of the elongated drive transmitter 9 instantaneously without play, cf. for example FIG. 15*b*.

Figure 13:
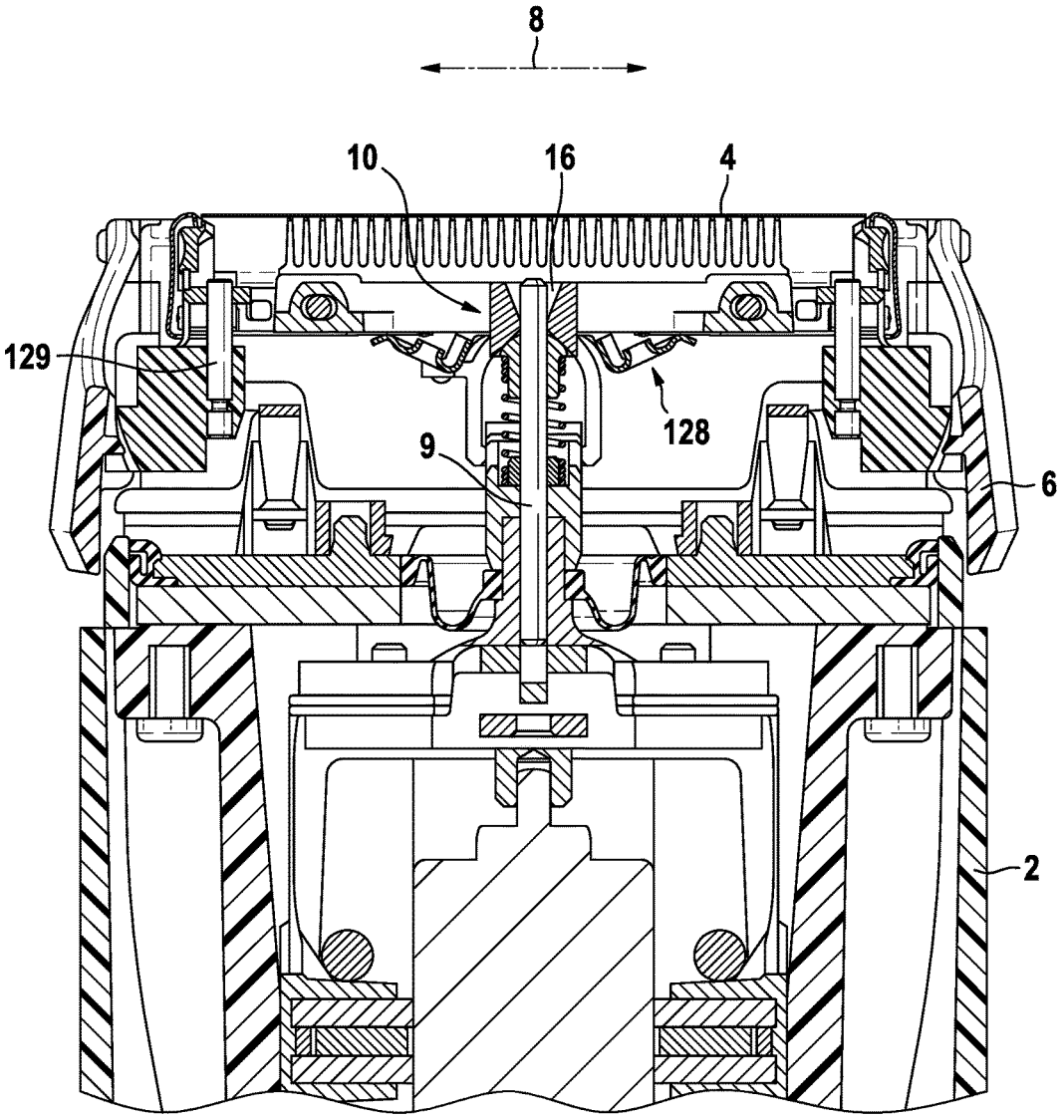
FIG. 13: a cross-sectional view of the shaver head of FIGS. 11 and 12 along line C-C in FIG. 11 going through the cutter element and the elongated drive transmitter connected thereto, illustrating the pivot joint connecting the elongated drive transmitter to the cutter element.

As shown by FIG. 13, the elongated drive transmitter 9 may be received directly within the interior transmitter recess 16 of cutter element 4. The elongated drive transmitter 9 may extend into said interior transmitter recess 16 formed in the cutter element 4 in which the end portion of the elongated drive transmitter 9 is received pivotably about the aforementioned pair of pivot axes 11 and 12 and is placeable in the direction transverse to cutter oscillation axis 8 and transverse to the longitudinal axis 13 of the drive transmitter 9. Said interior transmitter recess 16 of the cutter element 4 may form an elongated, slot-like hole having convex sidewalls defining the longer side of the slot and defining a cap the width of which substantially corresponds to the thickness of the end portion of the elongated drive transmitter 9, whereas the length of which is substantially larger than the thickness of the elongated drive transmitter 9.

The convex contouring of the aforementioned sidewalls may have a constant cross-section along the length of the slot-like hole. In other words, said convex sidewalls may have a curved shape, in particular the same curved shape in cross-sectional planes perpendicular to the length of the slot, whereas there is no curvature in cross-sectional planes parallel to the longitudinal direction of the slot.

Such curvature of said sidewalls defining the longer sides of the slot-like interior transmitter recess 16 may be adapted such that the elongated drive transmitter 9 may pivot relative to the cutter element 4 about pivot axis 12 extending transverse to the longitudinal axis 13 of the drive transmitter 9 and transverse to the cutter oscillation axis 8.

In addition, the cutter element 4 may pivot relative to the elongated drive transmitter 9 about pivot axis 11 substantially parallel to the cutter oscillation axis 8. When pivoting about said pivot axis 11, the elongated drive transmitter 9 slides within the slot-like interior transmitter recess 16. In addition, the elongated slot-like shape of the transmitter recess 16 allows for displacement of the cutter element 4 along the direction of pivot axis 12.

As can be seen from FIG. 13, the cutter element 4, more particularly the interior transmitter recess 16 thereof has no play against the elongated drive transmitter 9 in the direction of the cutter oscillation axis 8. The curved, bowed, convex sidewalls define a gap width corresponding to the thickness of the elongated drive transmitter 9 in a cross-sectional plane containing the cutter oscillation axis 8.

Said pivot joint 10 does not need to be rigidly, fixedly connected to said cutter element 4, but may be connected to a cutter element spring 128 connected to the cutter element body of cutter element 4 and elastically biasing the cutter element body against the shear foil 5 of the shaver head 3.

As can be seen from FIG. 13 said cutter element spring 128 may include at least one support arm elastically biased against and connected to the cutter element body, said biasing force trying to force the cutter element body away from the support arm and thus—according to FIG. 13 upwards—against the shear foil.

The said cutter element spring 128 and the cutter element body together may form a cutter element cartridge inserted into the shaver head 3, wherein the cutter element body may be guided by means of guide pins 129 or other suitable guiding contours so as to allow a floating or diving movement of the cutter element body in a direction—roughly speaking—substantially parallel to the longitudinal axis 13 of the drive transmitter 9 and/or substantially perpendicular to the skin contact side of the shaver head 3.

As can be seen from FIG. 13, the aforementioned cutter element spring 128 is coupled to the elongated drive transmitter 9 by means of pivot joint 10. Pivot joint 10 may be formed in various ways including the option to use a connector 15 having a slot-like or a cylindrical receiving recess for receiving the elongated drive transmitter 9, or direct engagement similar to the example of FIGS. 14*a* to 15*b*.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electric shaver, comprising a shaver housing, a shaver head including at least one cutter element drivable by a drive unit in an oscillating manner along a cutter oscillation axis and a non-cutting auxiliary function element for applying an auxiliary skin or hair treatment other than hair cutting to a skin portion to be shaved, said auxiliary function element having an applicator head positioned aside the cutter element, wherein said at least one cutter element is supported pivotably relative to said auxiliary function element and relative to a shaver head frame of said shaver head on a pivot frame at least about a pivot axis parallel to said cutter oscillation axis, wherein said at least one cutter element of said shaver head includes a plurality of cutter elements each of which is drivable in an oscillating manner along a respective cutter oscillation axis wherein each of said plurality of cutter elements is pivotably supported about at least said pivot axis parallel to said cutter oscillation axes, wherein the following (i) is provided:

(i) the applicator head of said auxiliary function element is positioned between a pair of said plurality cutter elements.

2. The electric shaver according to claim 1, wherein said auxiliary function element is rigidly supported to extend in a fixed position relative to said shaver housing and/or relative to said shaver head frame or shaver head housing.

3. The electric shaver according to claim 1, wherein the applicator head of said auxiliary function element includes a contact surface for contacting said skin portion, and/or forms a portion of the outer contour of said shaver head.

4. The electric shaver according to claim 1, wherein said auxiliary function element extends from said shaver housing through said shaver head with said applicator head forming a part of a skin contact side of said shaver head and/or a front side of said shaver head opposite to the shaver housing.

5. The electric shaver according to claim 1, wherein said at least one cutter element is supported displaceable relative to said auxiliary function element along at least one displacement axis extending transverse to said cutter oscillation axis.

6. The electric shaver according to claim 1, wherein said drive unit includes at least one elongated drive transmitter extending from said shaver housing into said shaver head and coupled to said at least one cutter element, said elongated drive transmitter is coupled to said cutter element by means of a pivot joint providing for movement of said at least one cutter element, wherein said pivot joint is displaceably mounted to said elongated drive transmitter and/or to said cutter element to allow for displacement of said pivot joint relative to said elongated drive transmitter and/or to said cutter element in a direction transverse to said cutter oscillation axis and transverse to said longitudinal axis of said elongated drive transmitter.

7. The electric shaver according to claim 6, wherein said elongated drive transmitter extends into an interior transmitter recess formed in said cutter element in which an end portion of said elongated drive transmitter is received pivotably about said pair of pivot axes and displaceable in said direction transverse to said cutter oscillation axis and transverse to said longitudinal axis of said elongated drive transmitter, wherein at least one of the following (iv) to (vi) is provided:

(iv) said elongated drive transmitter is in direct engagement with body walls of said cutter element defining said interior transmitter recess forming said pivot joint, wherein said interior transmitter recess of the cutter element forms an elongated, slot-like hole having convex side walls defining a gap the width of which substantially corresponds to a thickness of said elongated drive transmitter and the length of which is larger than said thickness of said elongated drive transmitter, said width extending parallel to said cutter oscillation axis and said length extending transverse to said cutter oscillation axis and transverse to the longitudinal axis of said elongated drive transmitter;

(v) wherein said pivot joint includes a connector connecting an end portion of said elongated drive transmitter to said cutter element, wherein said end portion of said elongated drive transmitter is received in a transmitter recess in said connector piece mounted to said cutter element, said transmitter recess of said connector forming an elongated, slot-like hole the width of which substantially corresponds to a thickness of the elongated drive transmitter and the length of which is larger than said thickness of said elongated drive transmitter to allow for displacement of said connector relative to said elongated drive transmitter in the direction transverse to said cutter oscillation axis and transverse to said longitudinal axis of said elongated drive transmitter;

(vi) said pivot joint includes a connector connecting an end portion of said elongated drive transmitter to said cutter element, said connector of the pivot joint forming a ball joint piece having a spherical support surface in pivotable engagement with a spherical support surface of the cutter element, wherein said spherical support surface of said connector is provided with flattening and/or bevelment portions providing for play of the connector relative to the cutter element and allowing for displacement of said connector relative to said elongated drive transmitter in the direction transverse to said cutter oscillation axis and transverse to said longitudinal axis of said elongated drive transmitter.

8. A shaver head for an electric shaver of claim 1, comprising said shaver head frame having an accommodating recess for accommodating said auxiliary function element for applying an auxiliary skin treatment to a skin portion to be shaved with an applicator head positioned aside the cutter element.

* * * * *